US005901841A

United States Patent [19]

Lusker

[11] Patent Number: 5,901,841

[45] Date of Patent: May 11, 1999

[54] CONTAINER, METHOD OF FILLING AND CLOSING, AND BLANK USED TO FORM THE CONTAINER

[76] Inventor: Ronald Lusker, 85 Mercer St., New York, N.Y. 10012

[21] Appl. No.: 08/912,571

[22] Filed: Aug. 18, 1997

[51] Int. Cl.[6] ..... B65D 21/00

[52] U.S. Cl. ..... 206/216; 220/23.83; 229/115; 53/467; 53/486

[58] Field of Search ..... 206/525, 216; 220/23.83, 23.86, 23.2, 23.4; 53/443, 448, 456, 457, 458, 467, 484, 486; 229/115, 116

[56] References Cited

U.S. PATENT DOCUMENTS 4,253,601 3/1981 Kossoff ..... 229/115

4,834,253 5/1989 Crine ..... 220/23.83 X

*Primary Examiner*—Jacob K. Ackun

*Attorney, Agent, or Firm*—Morgan & Finnegan, L.L.P.

[57] ABSTRACT

A container can be juxtaposed with another container to form an integrated package of containers. Each container is substantially triangular in horizontal section and forms first, second and third walls and has a top enclosed bottom. Each top of the container is formed as a substantially T-top closure formed from first and second pinched walls converging at the third wall. A container can be selectively dimensioned and juxtaposed together so that the containers form a rectangular configured package. The containers can be held together to maintain the juxtaposed containers in a substantially rectangular configuration.

30 Claims, 28 Drawing Sheets

CONTAINER, METHOD OF FILLING AND CLOSING, AND BLANK USED TO FORM THE CONTAINER

FIELD OF THE INVENTION

This invention relates to the forming, filling, and closing of containers and associated packaging, and more particularly, this invention relates to a container that can be juxtaposed to another container to form an integrated package for point-of-purchase display, a method of filling and then closing the container, and a blank used in forming the container.

BACKGROUND OF THE INVENTION

Point-of-purchase displays are becoming increasingly important in the global economy where stiff competition is ever present. Container design also is increasingly important in order to obtain containers that can be stored with minimum shelf requirements, while also allowing ready inspection of various containers and their contents. Also, multi-compartment containers are becoming increasingly important because a consumer may desire to purchase a integrated package of containers, with each container having a particular food material or other content such that the individual containers have different ingredients but are sold as an integrated package.

There is a need, then, for a container that is readily formable from a simple blank design but also can be juxtaposed with other containers in a pattern for point-of-purchase display, has ready visibility, and maintains minimum space requirements. The package also should be readily formed, from a blank, easily filled with any contents, closed and then opened by a consumer without difficulty.

It is also known to form multi-compartment containers such as that disclosed in U.S. Pat. No. 4,139,114 to Long, et al., where separate containers are juxtaposed into one compartmentalized package. The containers can be assembled together to form a package for point-of-purchase display and then multiply filled. The containers could be held together by a solder globule, such as disclosed in the '114 Long patent, by hook and pile fasteners (sold under the tradename Velcro™), such as disclosed in U.S. Pat. No. 5,007,540 to Beasely et al., or by interconnecting integrally formed components of containers such as disclosed in U.S. Pat. No. 5,158,191 to Douglas, et al. The packages formed from the assembled containers can then be grouped together to save space in a crowded display or storage area such as point-of-purchase display shelves in retail outlets.

A major drawback to some prior art integrated packages is the method and structure used to hold the containers together. A solder globule as disclosed in the Long '114 patent may not be aesthetically pleasing. Solder also may not be practical if the containers are formed from a material other than sheet metal, such as paperboard, plastic, or glass. Some of the containers may be aesthetically formed and pleasing to the eye with graceful and smooth sides and lines. Broken solder joints, hook and pile fasteners secured to the container sides, or integrally formed connectors would detract from the appearance of a container when it is separated from the overall package.

Another drawback of some prior art integrated packages is the time consuming process of separately filling each container, then assembling the containers together to form the package. If the containers were grouped together as a package prior to filling, the containers would have to be assembled and then advanced to a container filling station without production loss. In many instances, however, containers are aesthetically designed and noncylindrical, making high speed filling more difficult because a noncylindrical package is often more difficult to control during processing than a cylindrical package.

SUMMARY OF THE INVENTION

In accordance with the present invention, a container of the present invention is formed such that at least two of the containers can be selectively dimensioned and juxtaposed together so that the container form a rectangular configured package for point-of-purchase display. Each container is formed as an isosceles configured body that is substantially triangular in horizontal section and forming first, second and third walls and having a top and an enclosed bottom. The top of the container is formed as a substantially T-top closure formed from first and second pinched walls that converge at the third wall. The third wall of the container can converge inward toward a medial portion of the container defined at the T-top closure. The containers are preferably formed from plastic, glass, thin metal or paper board. The container can also be formed from a transparent material such that the contents of the container are readily visible to a viewer. When at least two individual, isosceles configured containers are juxtaposed together, the containers form a square configured package, which can be juxtaposed with other similar packages. The containers can be held together by an adhesive or tape. The containers can be filled either separately or when they are juxtaposed together in multiples of 2, 4, 8, 16, 32, 64 or more. This design is advantageous over other semicircular or cylindrical containers because a cylindrical container has a much greater void, which is not filled.

The present invention also includes a blank for forming the container in one aspect of the present invention. The blank is formed from a substantially rectangular, thin blank member formed from a thin, flexible material, and having top and bottom sides and parallel opposing sides. Three parallel fold lines extend from the top to the bottom side and parallel to the opposing sides. The blank forms first and second rectangular wall units corresponding to first and second walls of the container. A third rectangular wall unit is greater in width than the first and second wall unit corresponding to a third wall of the container.

A triangular configured bottom wall unit is formed at the bottom side of the third wall unit and has tabs extending therefrom and corresponding to the container bottom.

A triangular cutout is formed along the top side of first and second wall units and has an apex at the fold line dividing first and second wall units. The wall units are folded along first, second and third fold lines and the triangular configured bottom wall unit is folded along the bottom side so as to form an isosceles configured container body after filling the top of the container. First and second walls then may be pinched inward to converge against the third wall to form a T-top closure. A fold line can be positioned adjacent the top side on respective first and second wall units to aid in pinching first and second walls together against a third wall known to those skilled in the art. A side tab can be positioned adjacent to the first wall unit and extend from the top to the bottom side. A triangular configured reinforcing wall can extend from the bottom side of the first wall unit to act as a reinforcing wall to the corresponding container.

In accordance with another aspect of the present invention, an integrated package of containers is formed from a plurality of individual, isosceles configured containers that are substantially triangular in horizontal cross section and selectively dimensioned such that when juxtaposed together the containers are complementary fitting against the hypotenuse and form a square configured package at its base. The containers have converging side walls that extend toward the axial center of the integrally formed package wherein adjacent sidewalls are juxtaposed to each other. Each container is open at its top to enable filling, and then closed after having been filled.

A band extends circumferentially around the integrated package. The band includes support clips that engage each corner of the package. A tie band is operatively connected to each support clip and extends upward over the package toward a medial portion of the top surface of the package. Each tie band is joined together such that upward pulling on the joined tie bands causes the peripheral band to exert pressure on the periphery of the package to hold the individual containers together as an integral unit by shrink or blister packaging as known to those skilled in the art.

In still another aspect of the invention, each container has a substantially flat top and is substantially equal in height to each other such that the formed package has a substantially flat top surface. The tie bands are joined by a finger ring that is coextensive with the flat top surface of the package. The finger ring may be lifted from a position coextensive with the top surface of the package for exerting a pulling force on the circumferential band to ensure that the containers remain together. Each of the containers include a bottom shoulder and a top peripheral rim to allow stacking of the containers one on top of the other.

In accordance with another aspect of the present invention, a cylinder is received over the package so that the corners formed by the package are tangent to the interior surface of the cylinder. The cylinder allows the package to be advanced along a predetermined centripetal path of travel for subsequent filling either by engaging a guide or by rolling vertically or horizontally along a predetermined path of travel.

In one aspect of the invention, the containers can be formed by drawing a cup from an isosceles configured blank and draw ironing the cup into the isosceles configured container of desired dimension. Individual containers are then grouped together, and the cylinder placed over the group. The band and support clip can advantageously be detachably secured to the cylinder. The support clips can be designed so that the cylinder can be inserted and received over the package, but not removed unless pulled downward therefrom. Thus, after the tops are crimped onto the open-top containers, the cylinder can be removed downwardly from the container therefrom, while the band remains on the package.

DESCRIPTION OF THE DRAWINGS

The foregoing and other objects and advantages of the present invention will be appreciated more fully from the following description, with references to the accompanying in which.

DETAILED DESCRIPTION OF THE INVENTION

The present invention now allows the forming of an isosceles configured container that is readily juxtaposed to another container or a plurality of other containers so that the containers form a square or rectangular configured package, which is readily adaptable for point-of-purchase displays, and is also easily formed, inexpensive, readily filled, closed, and then easily opened by a consumer.

Figure 1A:
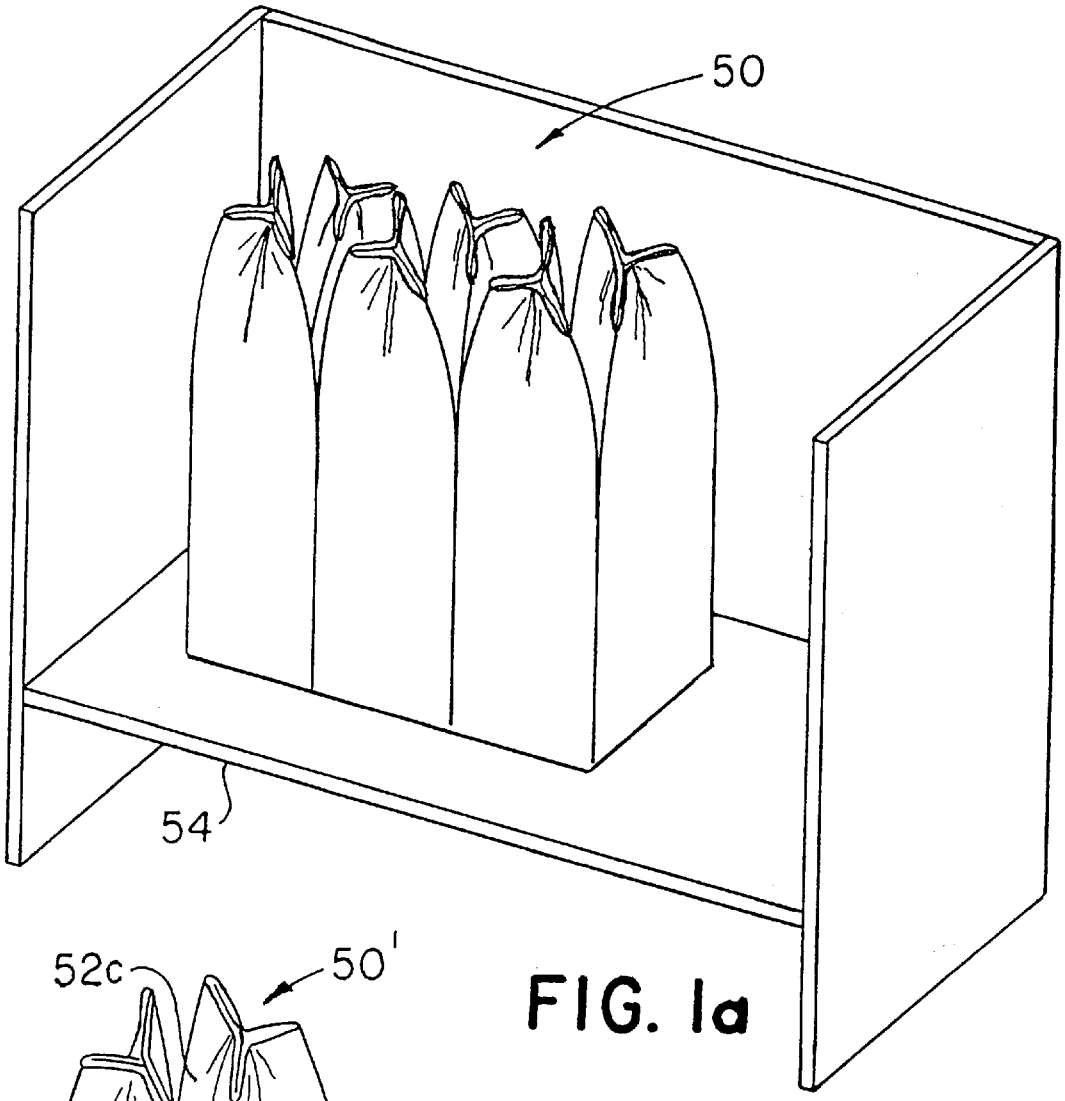
FIG. 1*a* is an environmental view of the integrated package of isosceles configured containers in accordance with one aspect of the present invention stacked on a point-of-purchase display shelf such as in a retail store.
Figure 1B:
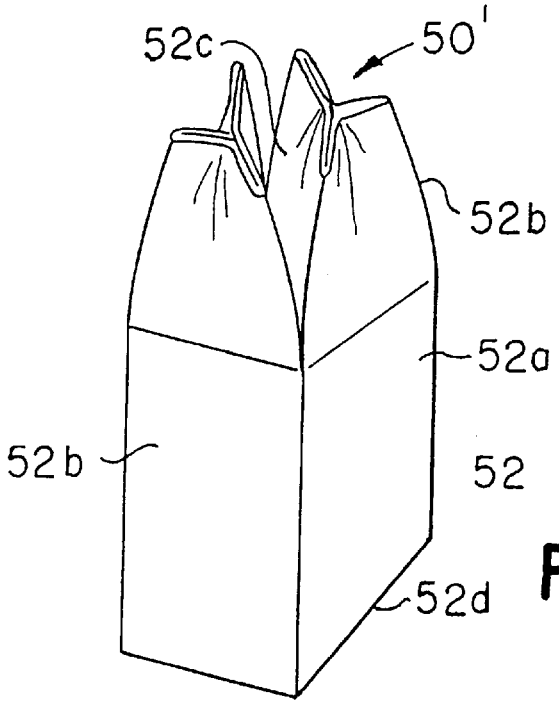
FIG. 1*b* is a perspective view of two isosceles configured containers of the type shown in FIG. 1*a*, juxtaposed together, and showing more clearly the T-top closure of each container.

Referring now to FIG. 1*a*, there is generally shown at 50 an integrated package of isosceles configured containers 52 that are held on a shelf 54 of a retail store display. Six containers 52 are illustrated and adhered together to form one package, as compared to FIG. 1*b* where two containers 52 are adhered together to form a package 50'. Each isosceles configured container has first and second walls 52*a*, 52*b* that are substantially equal, a third wall 52*c* forming a hypotenuse, and a bottom 52*d*.

The containers 52 can be formed of transparent plastic so that the contents are readily visible to a consumer. The use of transparent medium is advantageous when consumers want to inspect the container contents. Each container 52 in a package 50 could include the same contents as the other containers, or have different contents, such as rice, beans and noodles for a chinese cuisine dinner or latex and great for tile mix.

Figure 2:
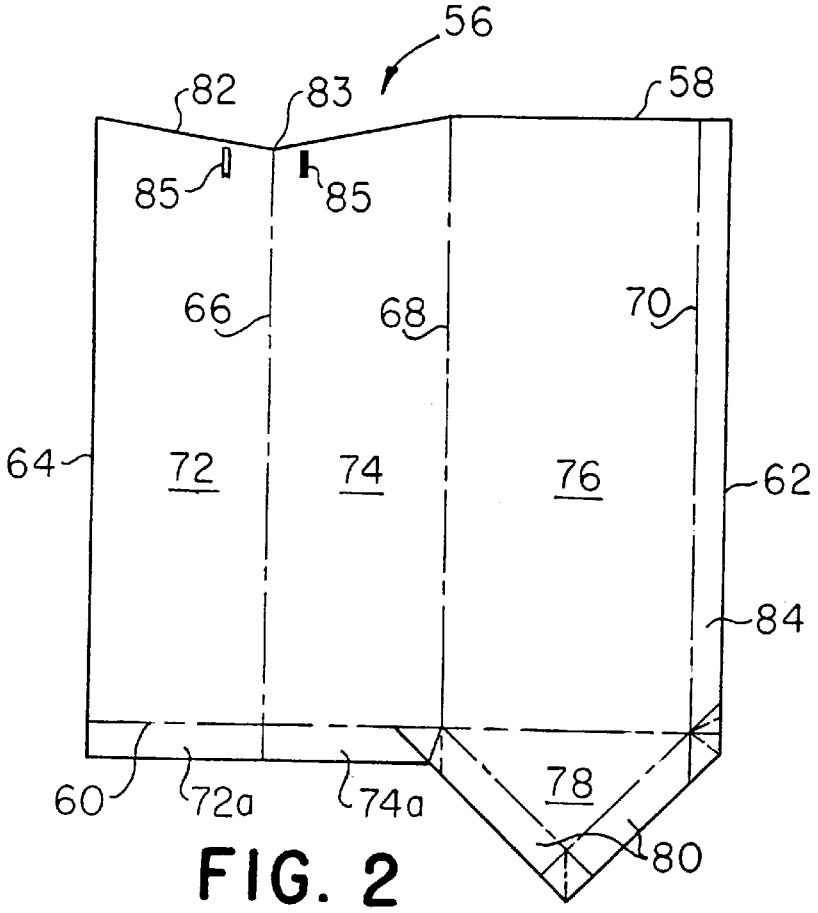
FIG. 2 is one blank design that can be used for forming the containers of FIGS. 1*a* and 1*b*, which could also be formed by flat calendar stock, metal annealing, vacuum forming and extruding or blow molding.
Figure 8:
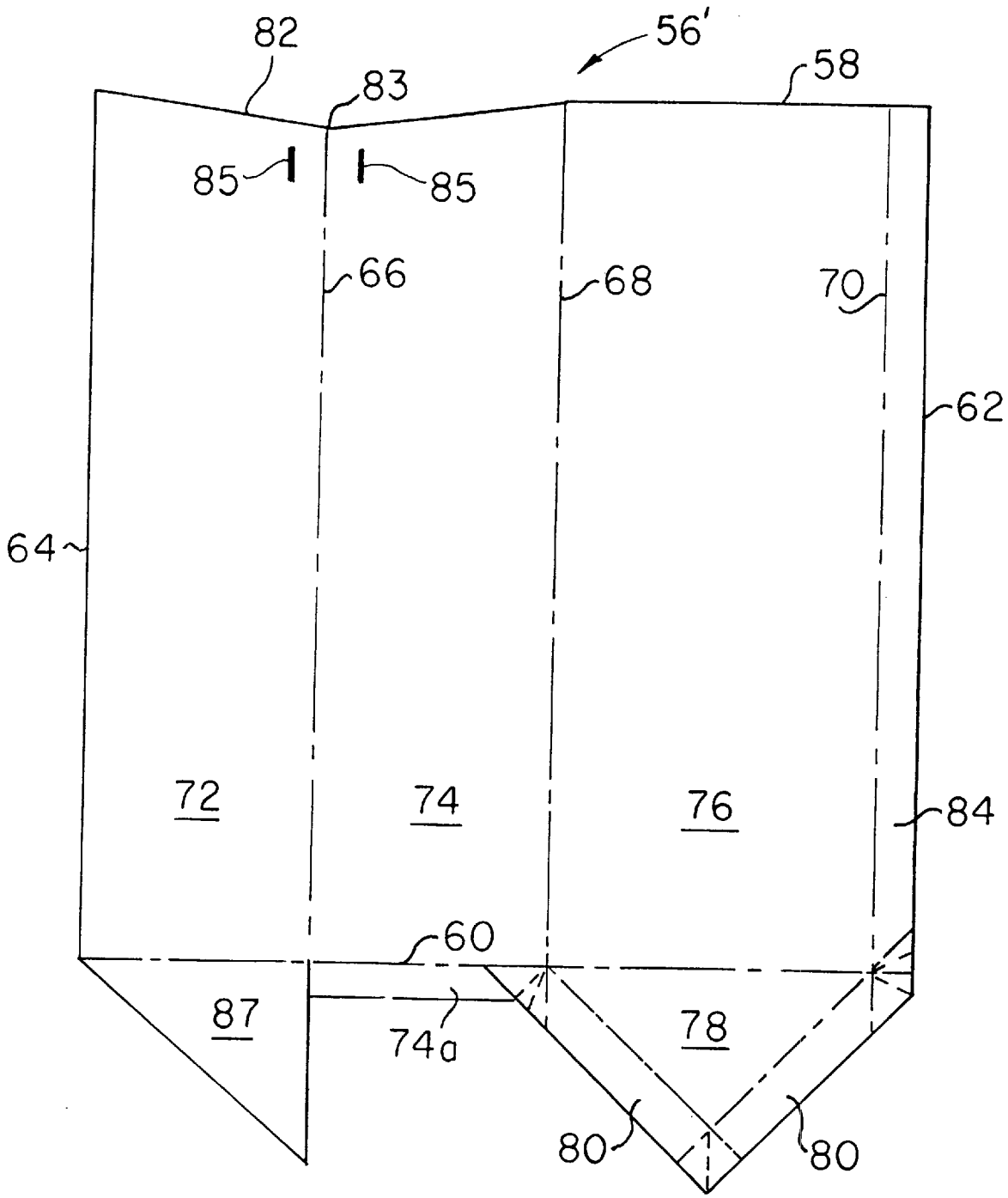
FIG. 8 is another blank design similar to the blank design of FIG. 2, but having an additional triangular tab forming a reinforcing wall for the bottom of the container.
Figure 9:
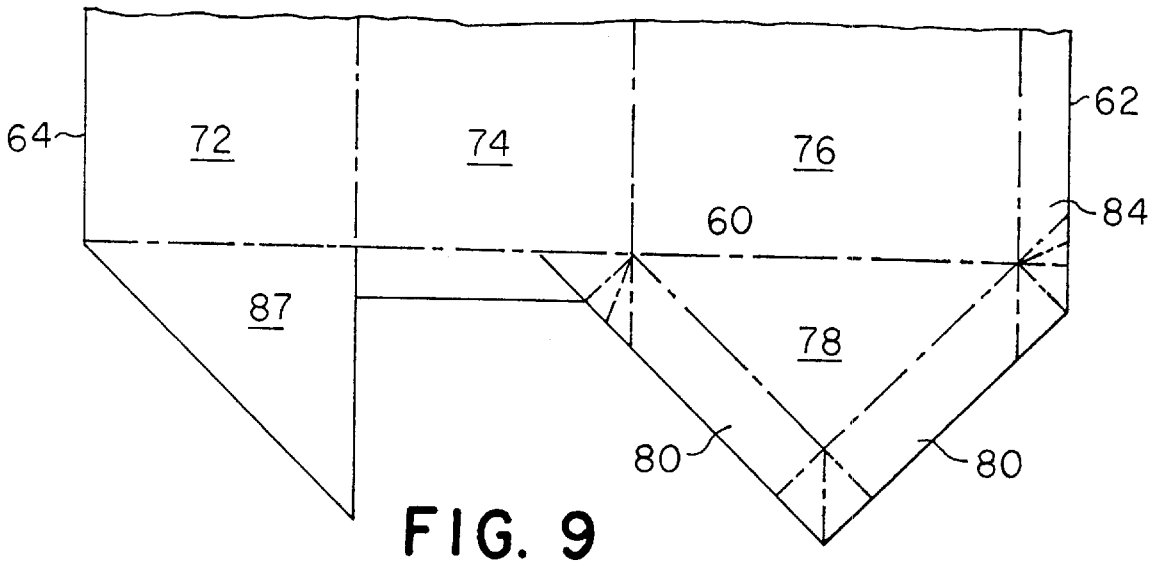
FIG. 9 is an enlarged view of the bottom portion of the blank shown in of FIG. 8.
Figure 11:
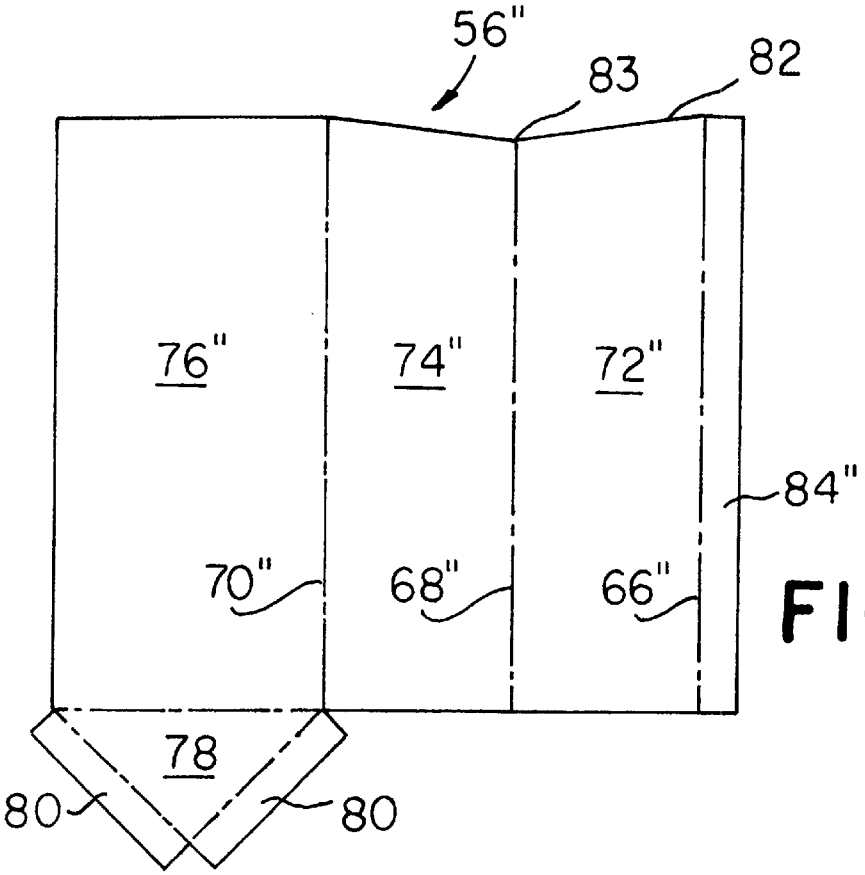
FIG. 11 is a modified blank design similar to that of FIG. 2.

Containers 52 can also be formed from thin metal, cardboard, thin paper board or any other flexible material that is adaptable to be formed as the blank shown in FIG. 2, FIG. 8, and FIG. 11. Alternately, plastic, metal or other material can be formed as a container blank and then punched (FIGS. 14*a* and 14*b*) into an open top container as shown in FIG. 15.

FIG. 2 shows one blank design that can be used for forming the containers 52, and is a substantially rectangular blank member 56 formed from a thin, flexible material such as paper board, metal or plastic. The blank member 56 has parallel top and bottom sides 58, 60 and parallel opposing sides 62, 64. Three parallel fold lines 66, 68 and 70 extend from the top 58 to the bottom side 60 and parallel to the opposing sides 62, 64. The blank member 56 forms first and second rectangular wall units 72, 74 corresponding to the first and second walls 52*a*, 52*b* of the containers 52. A third rectangular wall unit 76 is the hypotenuse and is greater in width than the first and second wall units and corresponds to the third wall 56 of the container 52 (FIGS. 4*c* and 4*d*).

Figure 3:
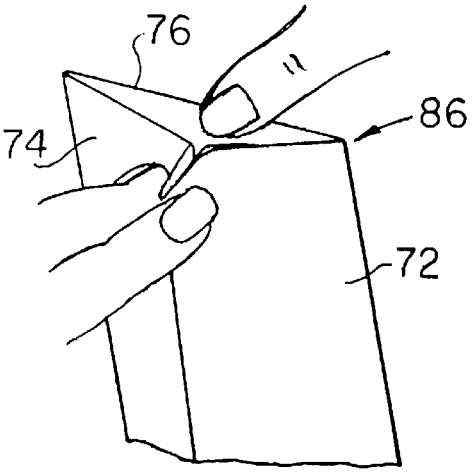
FIG. 3 shows the manual pinching of first and second walls against third wall.
Figure 4A:
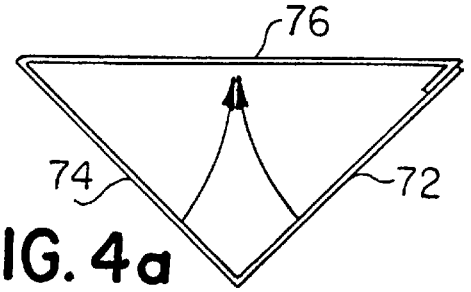
FIGS. 4*a* and 4*b* are schematic representations of how first and second walls are pinched together against the third wall.
Figure 4B:
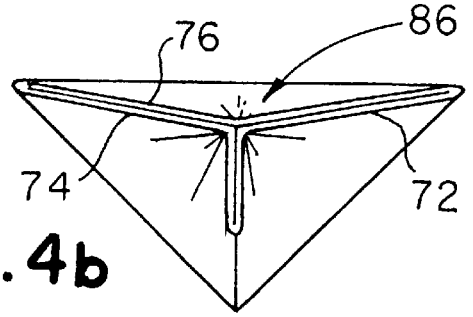

The blank member 56 of FIG. 2 includes a triangular configured bottom wall unit 78 formed at the bottom side 60 of the third wall unit 76 and has tabs 80 extending therefrom. The triangular configured bottom wall unit 78 corresponds to the container bottom 52*d*. A triangular cutout 82 is formed along the top side 58 of first and second wall units 72, 74 and has an apex 83 at the fold line 66 dividing first and second wall units 72, 74. A side tab 84 is adjacent the third wall unit 76 and extends from the top 58 to the bottom 60. A fold line 85 is adjacent to the top side 58 on respective first and second wall units 72, 74. The wall units 72, 74 and 76 are folded along first, second and third fold lines 66, 68 and 70 and the triangular configured bottom wall unit 78 folds along the bottom side 60 so as to form the isosceles configured container 52. The fold lines 85 allow the first and second walls 52, 52*b* near the top side 58 to be pinched inward to converge against the third wall to form a T-top closure indicated generally at 86 for a watertight seal. (FIGS. 3, 4*a* and 4*b*).

Figure 4C:
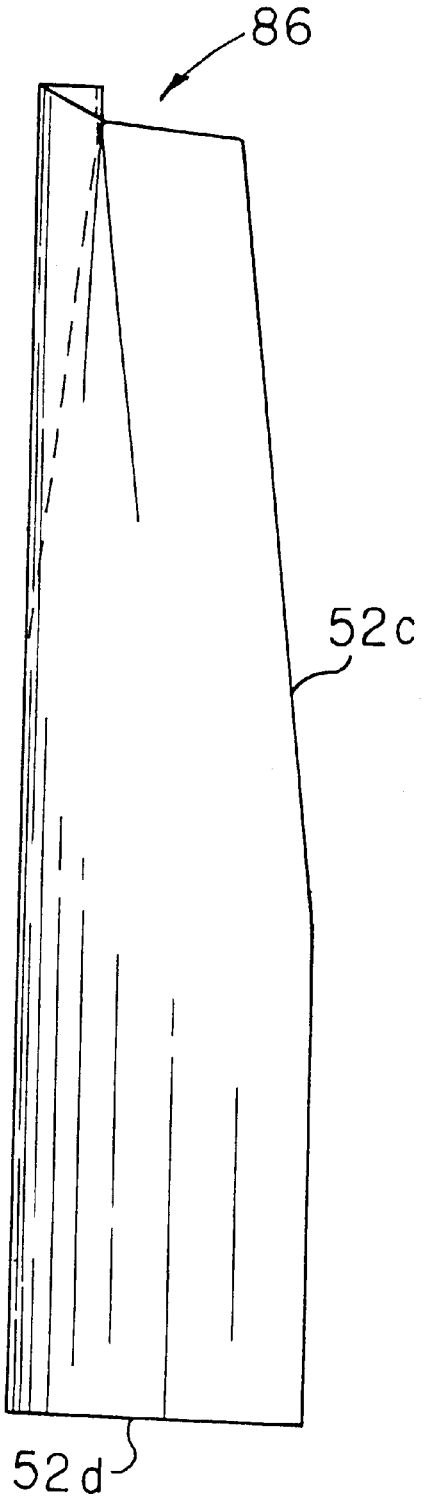
FIG. 4*c* is a side elevation view of a container of FIGS. 1*a* and 1*b*.
Figure 4D:
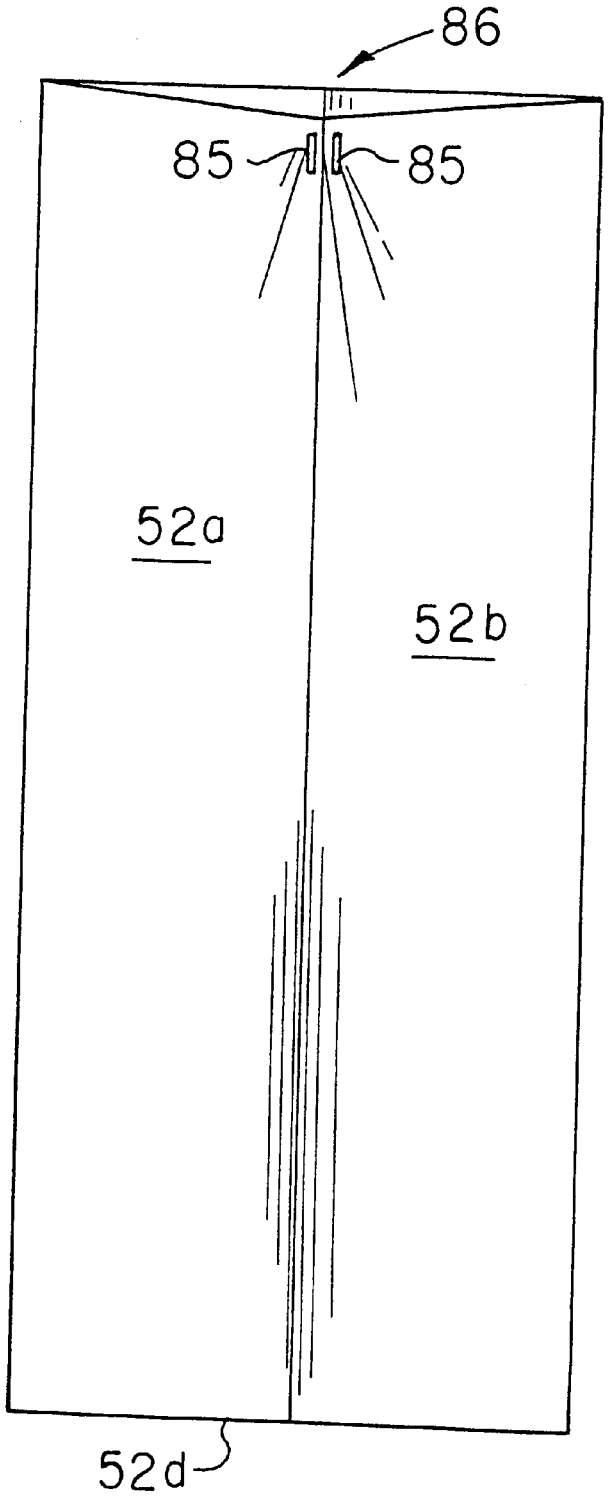
FIG. 4*d* is a front elevation view of a container of FIGS. 1*a* and 1*b*.
Figure 5:
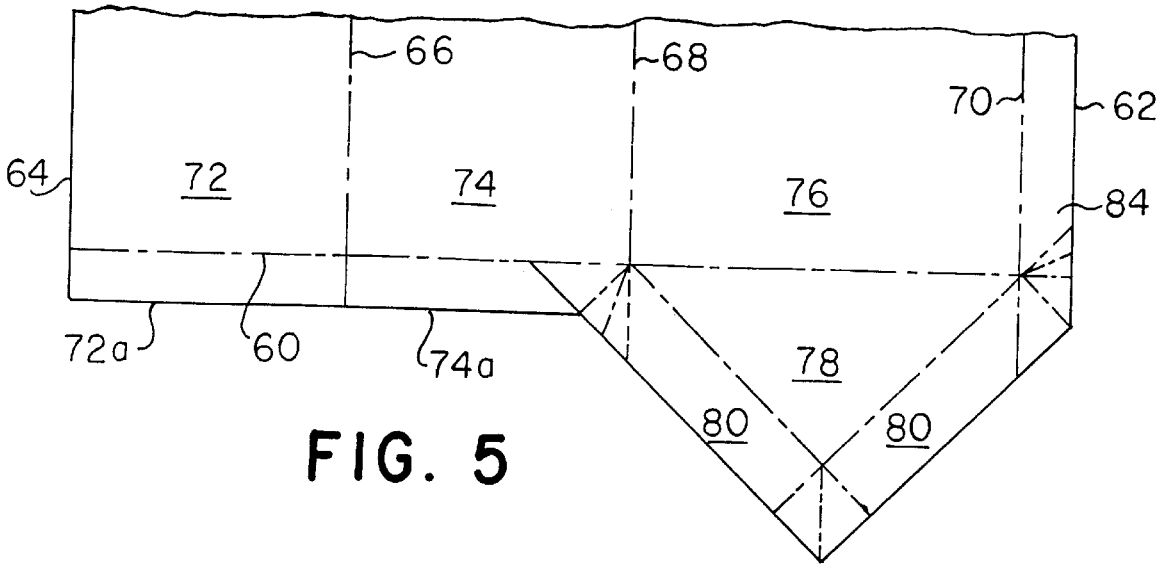
FIG. 5 shows an enlarged bottom portion of the blank design of FIG. 2.

FIGS. 4*c* and 4*d* shows the completed container 52.

Figure 6:
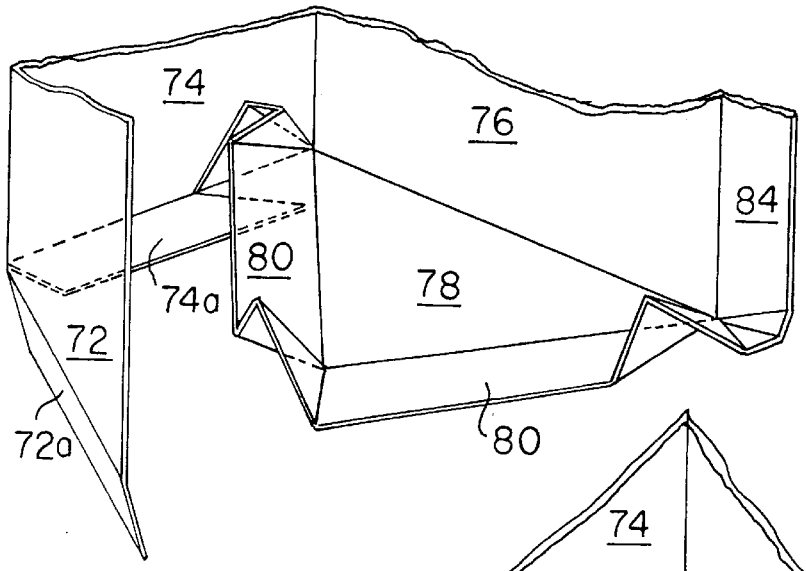
FIG. 6 is an isometric view showing the first steps of folding together the blank to form a container of FIGS. 1*a* and 1*b*.
Figure 7:
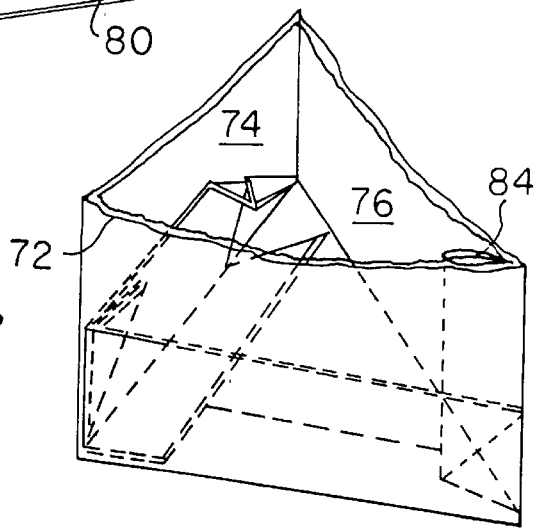
FIG. 7 is another perspective view of the folded blank showing the bottom portion of the almost completed container.

FIGS. 6 and 7 illustrate the folding operations as the triangular bottom wall unit 78 is bent 90° to form the bottom 52*d* and respective tabs 72*a*, 74*a* located on the bottom side of the first and second wall units 72, 74 then are folded 90° together with the triangular wall unit tabs 80. The structure is secured with adhesive or tape.

FIG. 7 illustrates the completed container 52.

FIG. 8 illustrates a modified blank design, where the modified blank member 56' includes an additional triangular configured reinforcing wall 87 extending from the bottom side 60 of the first wall unit 72 to act as a reinforcing wall to the corresponding container bottom 52*d*.

Figure 10:
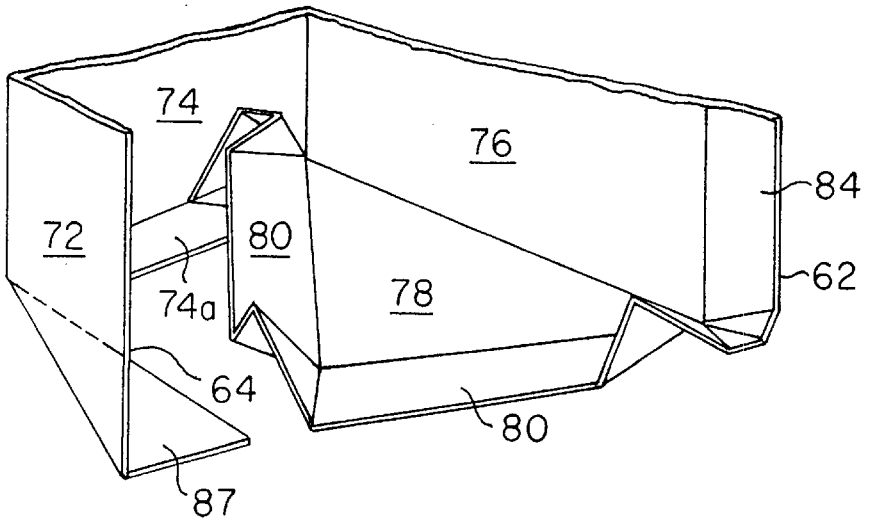
FIG. 10 is an enlarged perspective view showing the first folding step for forming the container using the blank design of FIG. 8.

FIG. 10 shows the folding operation which is similar to the folding operation of FIGS. 6 and 7, but with a the triangular configured reinforcing wall 87 folded 90°.

FIG. 11 illustrates a modified design of the blank member 56" where no tabs extend from the bottom of the first and second wall units, and side tab 84" is adjacent the first wall unit 72". First fold line 66" divides the side tab 84" and first wall unit 72". The second fold line 68" divides first and second wall units 72" and 74". The third fold line 70" divides second and third wall units 74" and 76".

Figure 12:
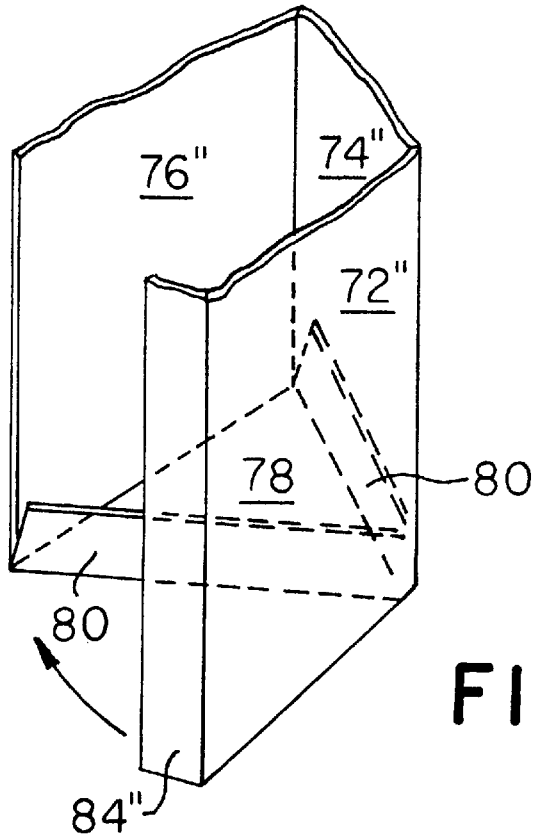
FIG. 12 is a perspective view showing the first folding step using the blank design of FIG. 11.

FIG. 12 illustrates folding of the container of the blank member of FIG. 11.

The isosceles configured containers can also be formed from a plastic or other material that can be extruded, punched or pressed by manufacturing methods known to those skilled in the art.

Figure 13:
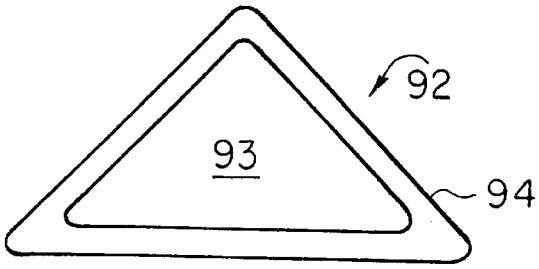
FIG. 13 is a bottom plan view of a container of the present invention that can be extruded or stamped from a blank.
Figure 14A:
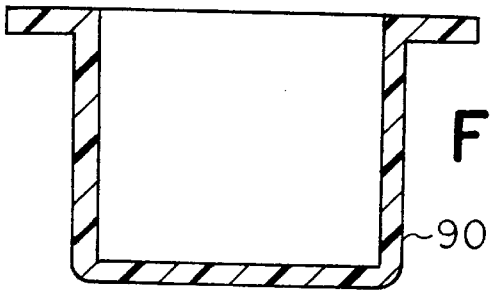
FIG. 14*a* shows a blank that can be used in forming a container of FIGS. 1*a* and 1*b*.
Figure 15:
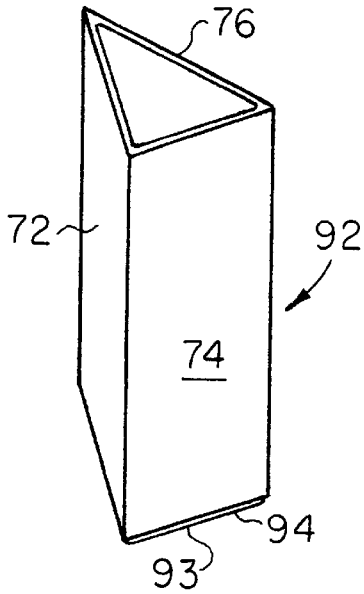
FIG. 15 shows the completed container formed from the step of FIG. 14*b*.
Figure 14B:
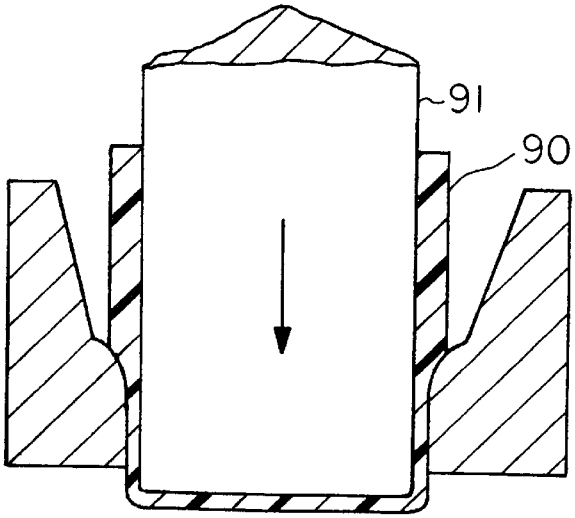
FIG. 14*b* shows a punch die punching the blank to form a thin walled container shown in FIG. 15 where the second walls can be pinched against the third wall.
Figure 62:
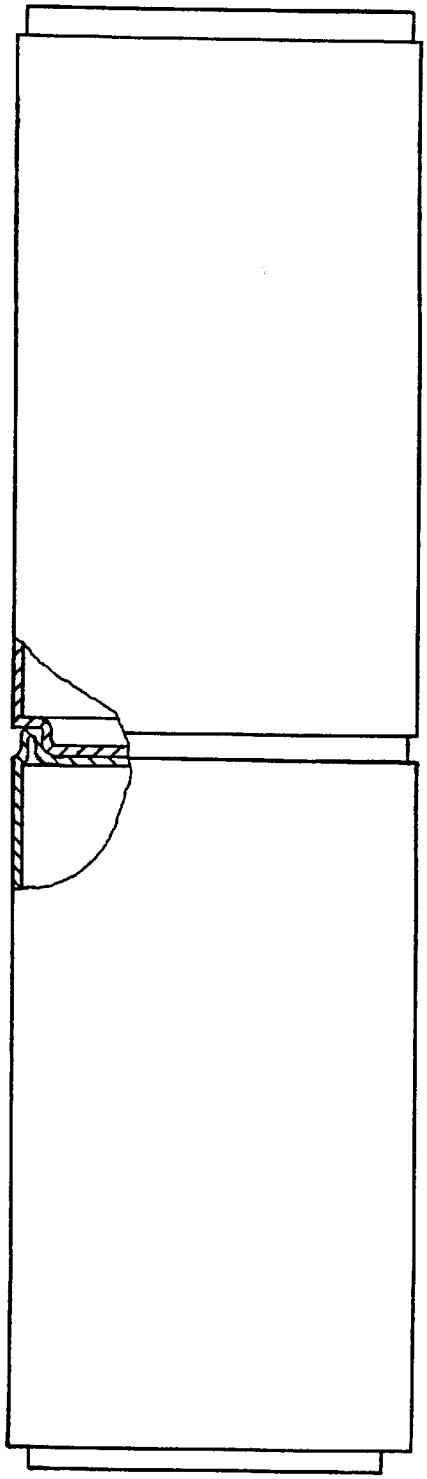
FIG. 62 shows two containers positioned on top of each other.

FIGS. 14*a* and 14*b* illustrate a punch operation where a blank 90 shown in FIG. 14*a* is pressed by a triangular configured punch 91 to form the isosceles configured open top container 92 of FIG. 15. The bottom 93 of the container 92 as shown in FIG. 13 can include a ridge 94 or other member that allows vertical stacking as shown in FIG. 62.

Figure 16:
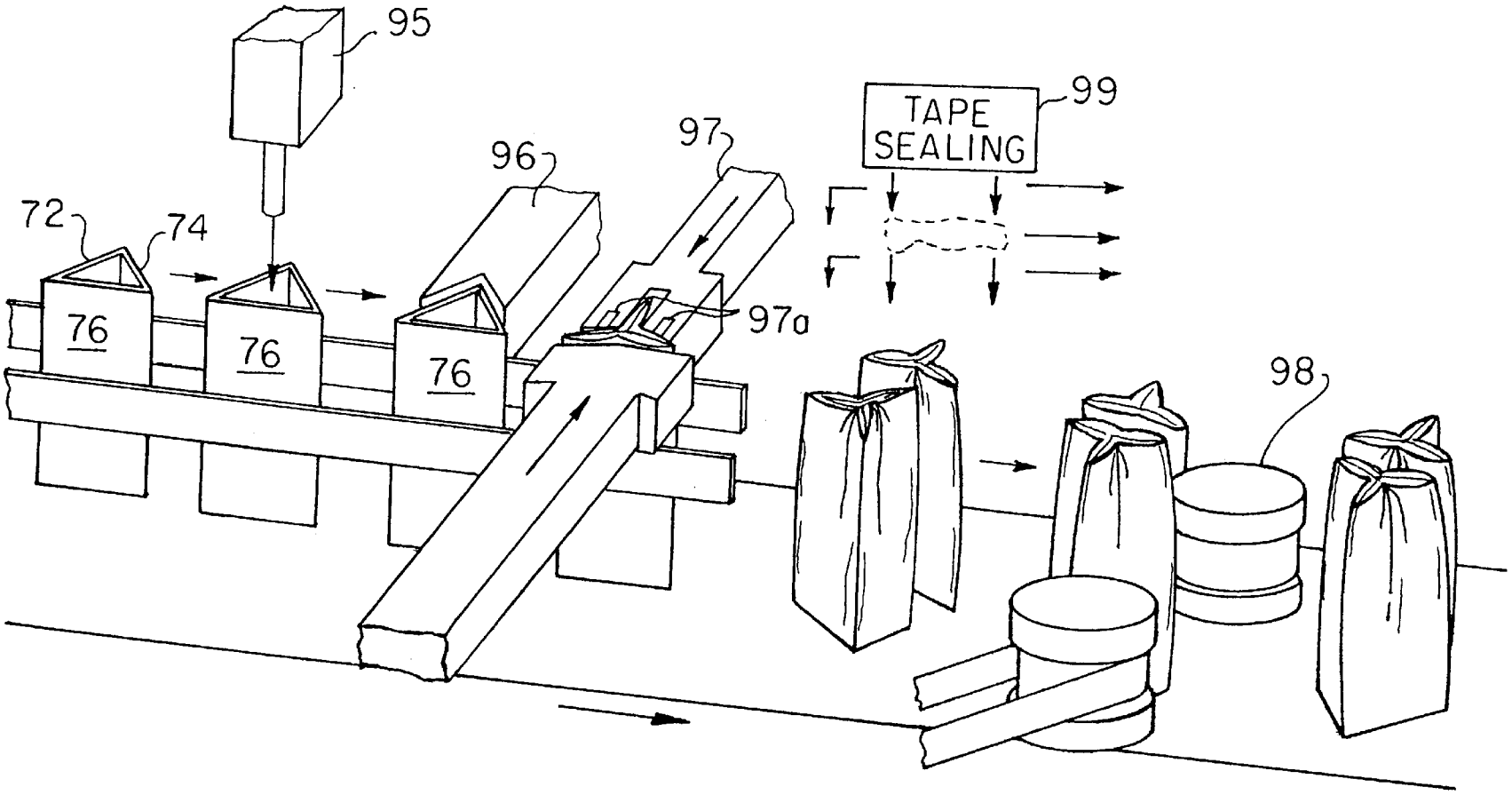
FIG. 16 shows a manufacturing sequence for filling containers, pinching first and second walls against the third wall, and juxtaposing two containers together to form a rectangular configured package.

In the fill and close operation shown in FIG. 16, the open-topped containers 52 are filled by fill mechanism 95, which can measure and then deposit the proper amount of contents. A first die 96 initially presses the first and second walls in the direction toward the third wall 76. A second die 97 then clamps first and second walls in a pinched configuration. The second die can include heated members 97*a* which could heat an activated adhesive that is contained on the inside of the container at the top portion so that the T-top closure is sealed in a closed position. Alternatively, sanitary tape could be added during this step of closure to seal the T-top closure.

As shown in FIG. 16, the containers could be merged together by appropriate merge mechanism 98 known to these skilled in the art and then a tape sealing unit 99 could add adhesive tape onto the containers to hold them together or to add an additional seal.

In accordance with another aspect of the present invention, the present invention can provide an integrated package of containers formed from a plurality of individual, isosceles configured containers that are selectively dimensioned so that when juxtaposed together, the containers have complementary fitting sidewalls, forming a square for a square or rectangular configured package.

For purposes of description, the containers used in these examples are indicated by reference numerals starting in the 100 series and extending until the 200 and 300 series.

In accordance with the present invention, rapid centripetal filling is facilitated by means of the present invention where a cylinder is received over the package such that the package corners are tangent to the interior surface of the cylinder. The cylinder includes a band detachably secured therein, which extends circumferentially around the package. The band has support clips which engage each corner of the package and the interior of the cylinder. After filling and closing of the open topped containers, the cylinder is removed downward from the package, leaving the circumferential band in place.

Figure 17:
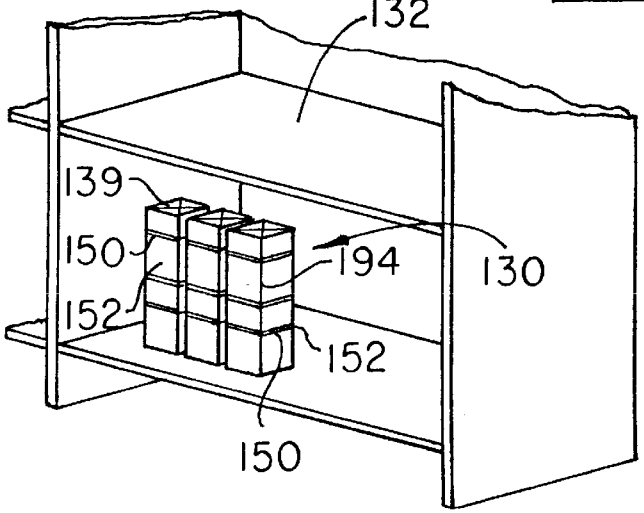
FIG. 17 is an environmental view of another integrated package of containers in accordance with the present invention stacked on a point-of-purchase display shelf such as in a retail store.

Referring now to FIG. 17, there is shown at 130 a plurality of integrated container packages in accordance with the present invention, which are stacked side-by-side and nestled one on top of the other on a shelf 132 such as commonly used in point-of-purchase display shelves.

In the illustrated embodiment of FIG. 17, each package 130 is formed from four individual, isosceles configured containers, indicated generally at 134 (FIG. 28), which are substantially triangular in horizontal cross section and selectively dimensioned such that when juxtaposed together, the containers 134 have complementary fitting sidewalls that form a square base for a rectangular configured package. Each container 134 has a substantially flat top 136 and bottom 138 and is substantially equal in height such that the formed package 130 has a substantially flat top surface 139.

Figure 28:
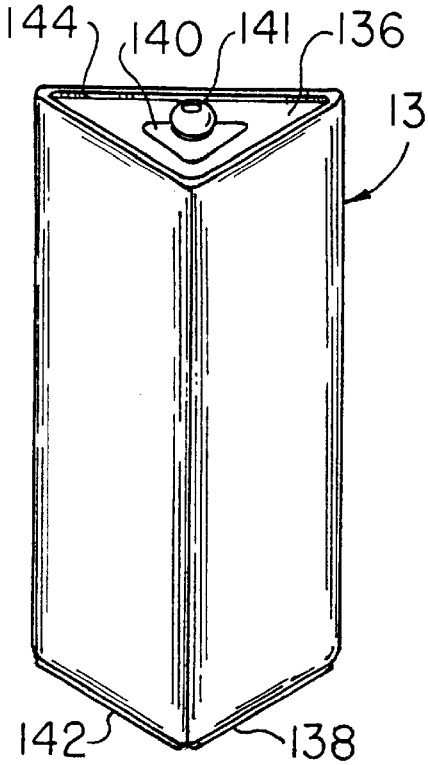
FIG. 28 is a front perspective view of one isosceles configured container illustrating the peripheral rim on the top which engages the bottom shoulder for stacking the containers one on top of the other.

The top surface 136 of each container includes a pull-up tab 140 which allows snap opening of the container by pulling upward on a lift ring 141 (FIG. 28). As also illustrated in FIGS. 17 and 28, the containers 134 have a bottom shoulder 142 and top peripheral rim 144 for allowing stacking of the containers 34 one on top of the other, the containers can be stacked singularly or in a group package as shown in FIG. 17. The containers can vary in size and cross section depending on the desired end use.

In one embodiment, the illustrated four containers are grouped together and held by a band 150 that extends circumferentially around the integrated package (FIGS. 17 and 22 through 27). The band forms a strap carrier for holding the containers together especially during filling and subsequent processing. The band 150 can be formed from light sheet metal, flexible polymeric material, or other flexible material.

The band 150 includes right-angle configured support clips 152 that are configured to engage each corner of the formed package 130. As will be explained later, the support clips 152 are also designed so that the clips 152 initially engage the interior wall of a guide cylinder 156 that is dimensioned to slide over the formed package. The support clips 152 and band 150 are initially positioned within the cylinder 156. The cylinder 156 is received over the package 130 of containers. The band 150 and clips 152 engage the periphery of the container and its corners. The clips 152 are designed so that they prevent upward movement of the cylinder 156 over the package 130, but allow downward movement from the package so that the cylinder can be removed from the formed package after filling and closing of the containers 134. Each support clip 152 is formed as a right angle bent half oval section having a larger support base and tapering side edges narrowing upward to a common point. Each support clip has an inner surface engaging the corner areas defined by the package and an outer lower corner engaging the inner surface of the cylinder received over the package. The base engages with further pressure the inner surface of the container upon the application of an upward biasing force exerted on the cylinder while allowing sliding action of the cylinder over the base when a downward biasing force is exerted against cylinder.

Each tie band 160 merges together to form a single length of tie band at the intersection of the medial portion to form a carrying wire extends vertically from the tie band such as by a pulling finger ring 162 which is connected at the distal end of the carrying wire tie band.

A tie band 160 is operatively connected to each support clip 152 and extends upward along the formed package corners 194 where two containers 134 are juxtaposed together and then along the top surface towards a medial portion of the package (FIGS. 22–27). Each tie band 160 in the preferred embodiment is joined together by a finger ring 162 which extends coextensive with the flat top 139 surface of the formed package. The finger ring 162 may be lifted from a position coextensive with the top surface of the package for exerting a pull on the circumferential band 150. The band 150 is preferably positioned about one-third of the distance from the top of the package, so that the package is more stable when it is lifted.

For purposes of understanding, the method of forming the package and then filling the package with a fluid will be described in detail below.

Figure 19A:
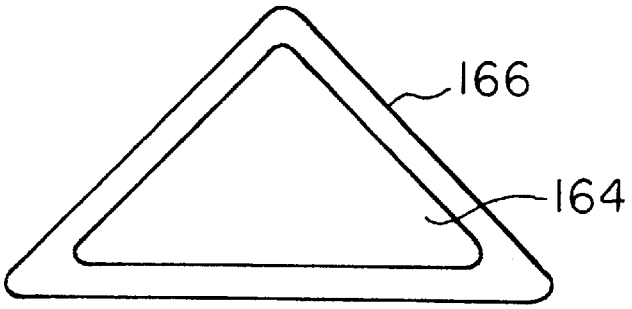
FIG. 19*a* is an isosceles configured blank used in the cupping procedure for forming the container of FIG. 17.
Figure 19B:
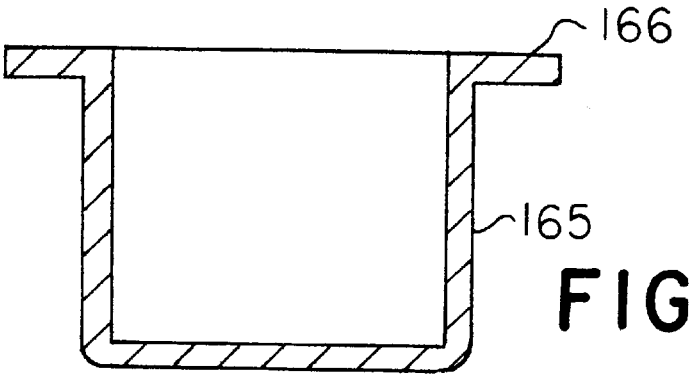
FIG. 19*b* is a sectional view of the draw formed cup.
Figure 19C:
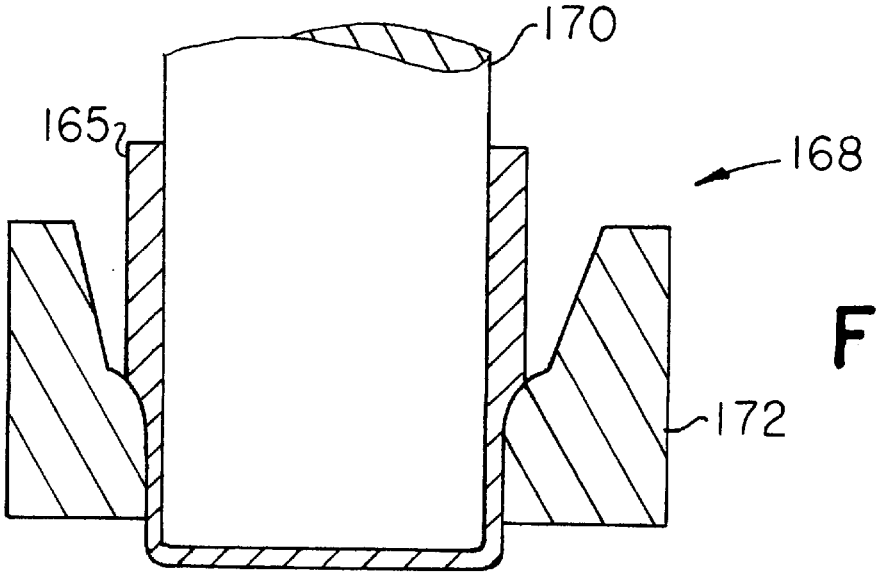
FIG. 19*c* is a sectional view of an ironing procedure to form the basic container shown in FIG. 17.

In a preferred aspect of the invention, aluminum or thin sheet metal such as "tin plate" is rolled into a cupping press where it is tested for pin holes and dimensional thickness using ultra-violet light. Instead of a circular disk blank such as commonly used in a cupping press, an isosceles shaped (triangular configured) blank 164 (FIG. 19*a*) is used. The isosceles configured blank is pressed and then drawn in a cupping press with very little waste as compared to circular disks (FIG. 19*b*). As shown in FIG. 19*b*, the blank 164 becomes an isosceles configured, drawn cup 165 having flanges 166 where the press had supported the blank during cupping. It is anticipated that a normal cupping press can press sixteen or more cups at a single stroke producing 30,000 pieces per hour.

The formed cups are then drawn into full containers 134 by the use of a wall ironing machine shown schematically at 168, which uses a series of rings that force a punch 170 through a number of progressively smaller rings 172 to extrude the basic isosceles shaped container.

Figure 35:
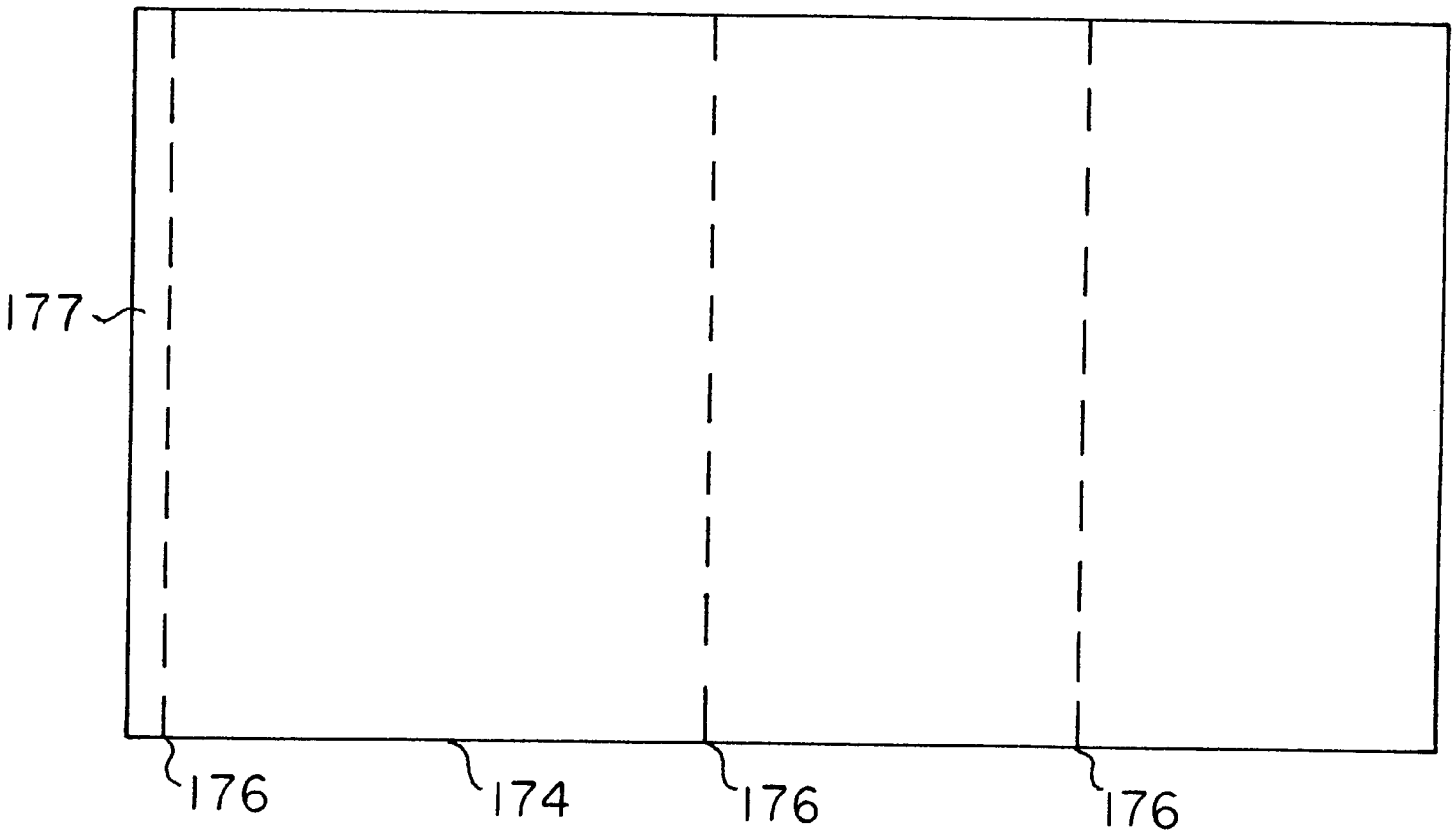
FIG. 35 is the layout of a blank that may be used for forming a container such as shown in FIG. 28.
Figure 36:
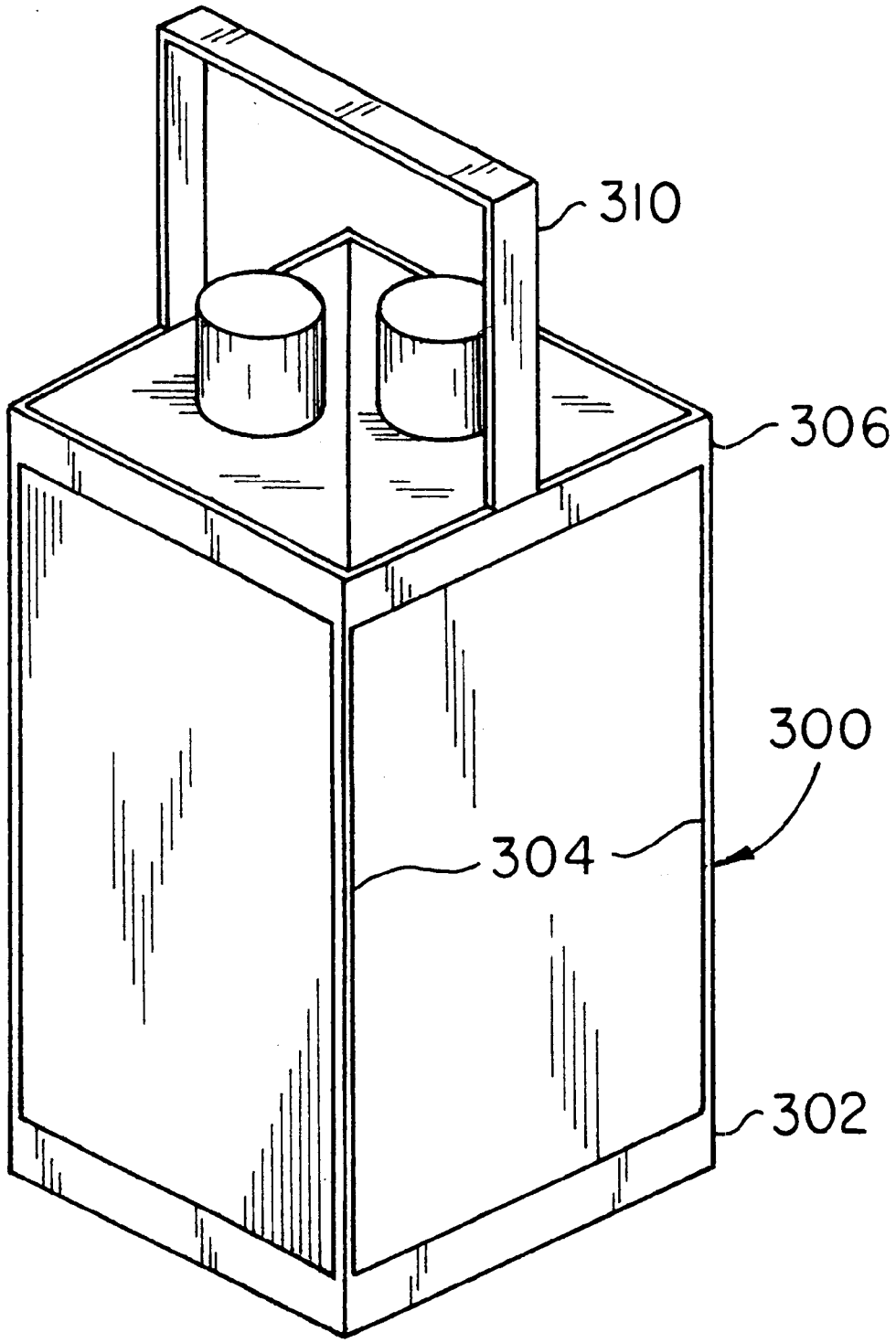
FIG. 36 is a perspective view of a carrier used for holding two isosceles configured containers that form a square configuration in plan view.
Figure 37:
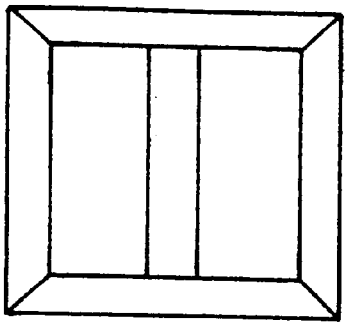
FIG. 37 is a plan view of the carrier shown in FIG. 36.
Figure 38:
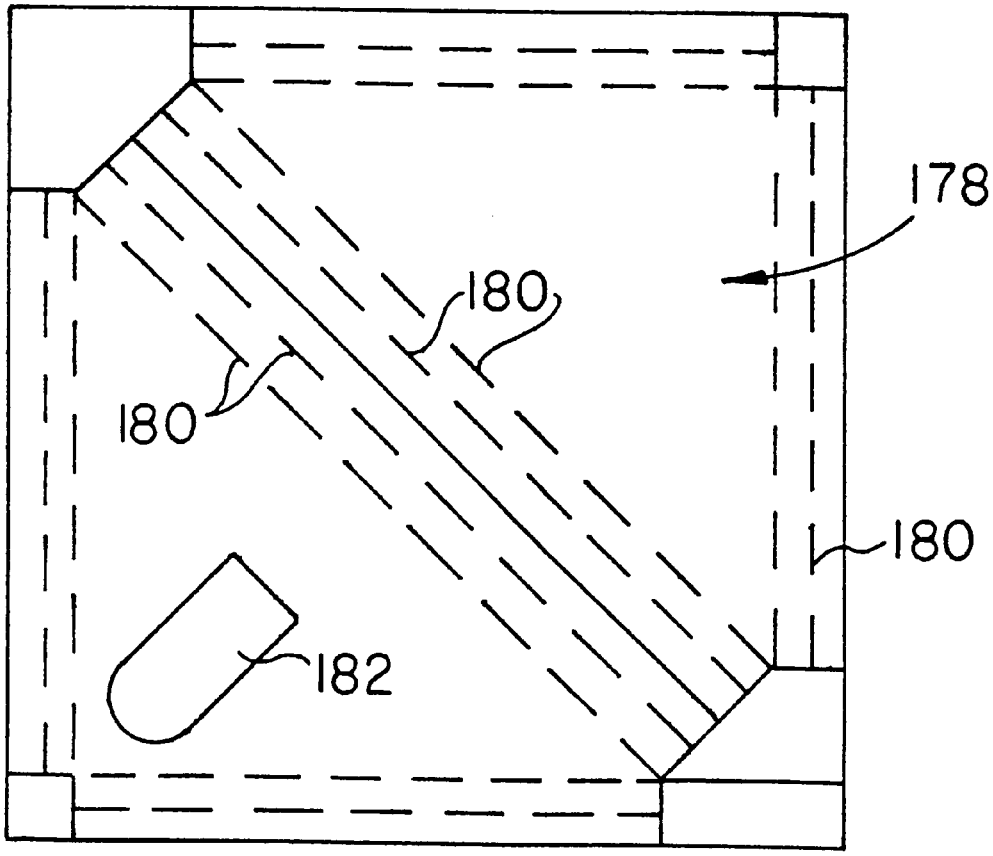
FIG. 38 is a layout of a blank for the top and bottom used in the container of FIG. 28.

Alternatively, the isosceles configured container 134 can be formed from a flat blank 174 of thin metal, such as tin plate, and formed and bent at the indicated indicia lines, which could be score lines or other lines of weakening 176, using a brake or other apparatus. The formed container is then welded or adhesively seamed at the overlapping joint (FIG. 35). The top and bottom portions 136, 138 of the container then are formed from another blank 178 (FIG. 38). Typically the bottom portion 138 of the container corresponds to one isosceles side of the blank defined by a diagonal line drawn from corner-to-corner. The top portion 136 is formed from the other isosceles side.

The bottom portion 138 is added first to the formed container, secured by crimping or other means, followed by securing the top portion after filling. Score lines 180 on the blank indicate areas of bending. The tab area 182 positioned in a medial portion corresponds to the pull-up tab 140. The lift ring 141 or other similar opener mechanism is later applied to the tab area 182. If a plastic or glass container is desired, the material may be blown or extruded.

Figure 18:
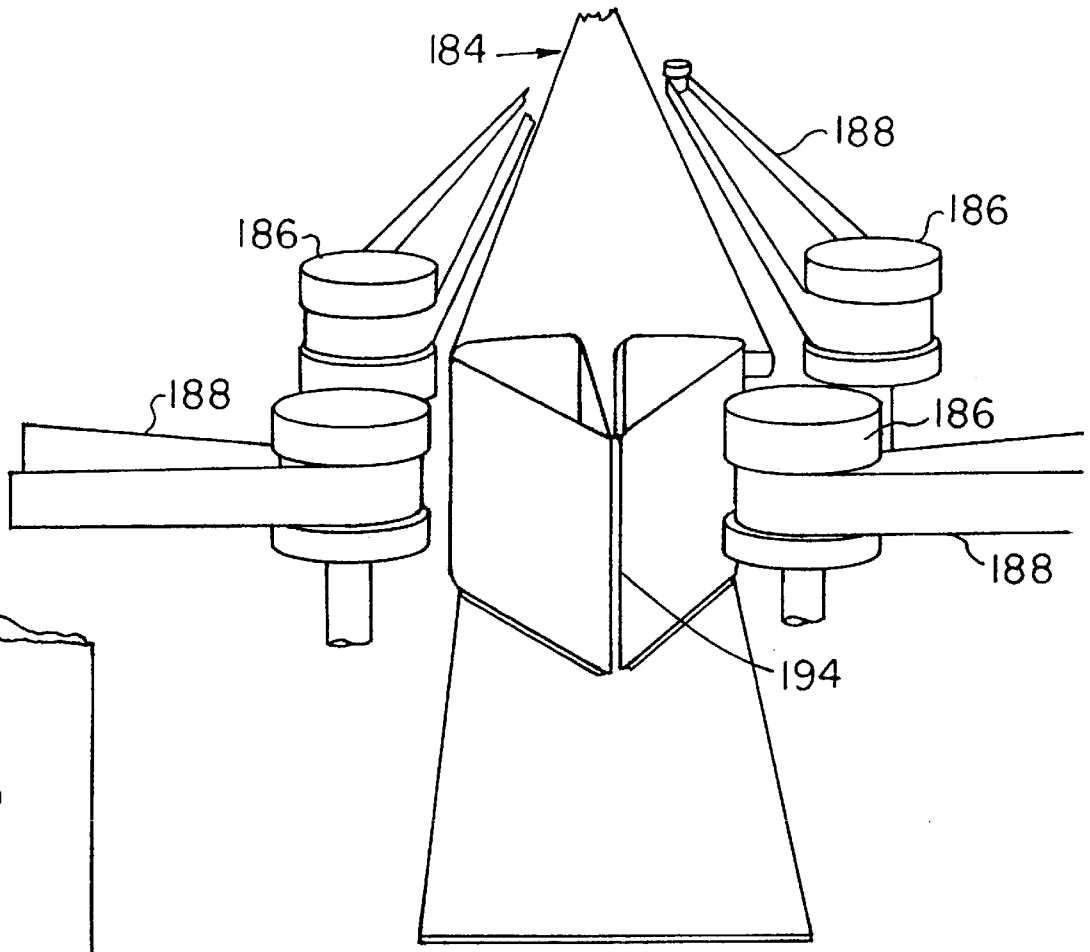
FIG. 18 is a schematic, perspective view of a portion of the assembly line showing two individual containers being merged together to form a part of the open top package.

Once the isosceles configured container is formed, the excess material formed during cupping and ironing is removed such as by conventional trimming. The container is flared for necking, then washed, dried, painted, finished and tested. In one manufacturing method, the containers are then merged together on a container merging line such as a belt conveyor line 184 (FIG. 18) which joins the containers together by mandrel 186 and belt 188 assemblies.

Figure 39:
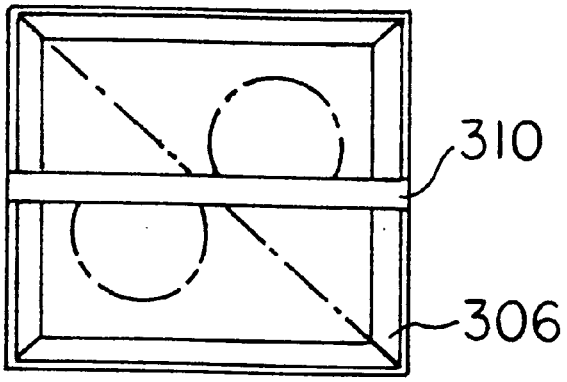
FIG. 39 is a plan view of a carrier used for supporting two isosceles configured containers.
Figure 40:
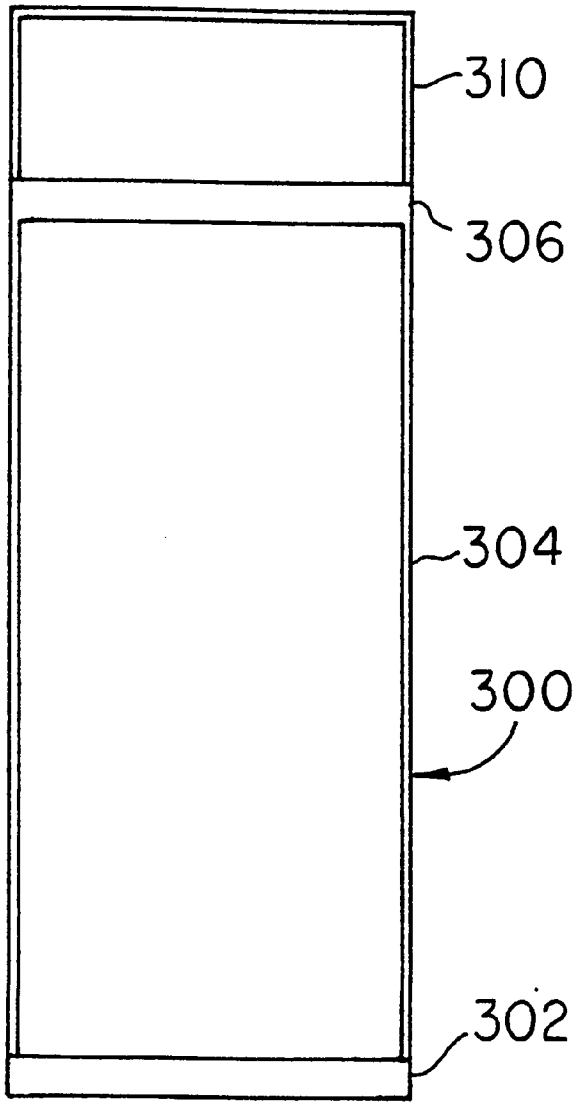
FIG. 40 is a side elevation view of the carrier of FIG. 21.

Although the illustrated embodiment in FIG. 17 shows four containers assembled together to form a substantially square configuration, any number of containers can be merged together as long as the rectangular (and preferably square for supporting the cylinder 156) (FIG. 39) configuration is established. Four, 16, 36 or 256 containers could be merged together and formed into the desired square configuration. It is anticipated, however, that four merged containers are advantageous because the smaller number of containers would be more manageable during filling and transport. The illustrated merging method is only one method illustrating how the individual containers could be placed together in a group. Those skilled in the art will understand the numerous ways the containers could be placed together.

In accordance with one method and apparatus of the invention, the cylinder 156 has the band 150 and clips 152 detachably positioned therein. The cylinder 156 is engaged by a cylinder grip mechanism 190 and placed over the formed package such that the support clips 152 engage the corners of the package 130, holding the individual containers together. The tie band 160 could extend upward from the clips 152 along the merged seam 194 (FIGS. 18, 22, and 26) and across the top seam between adjacent containers such that the tie band 160 would not interfere with high speed container filling as fluid is inserted from the top. Additionally, the tie bands 160 could extend loose from the support clips 152 and be joined together only after filling and the tops 136 have been placed on the containers.

Figure 21A:
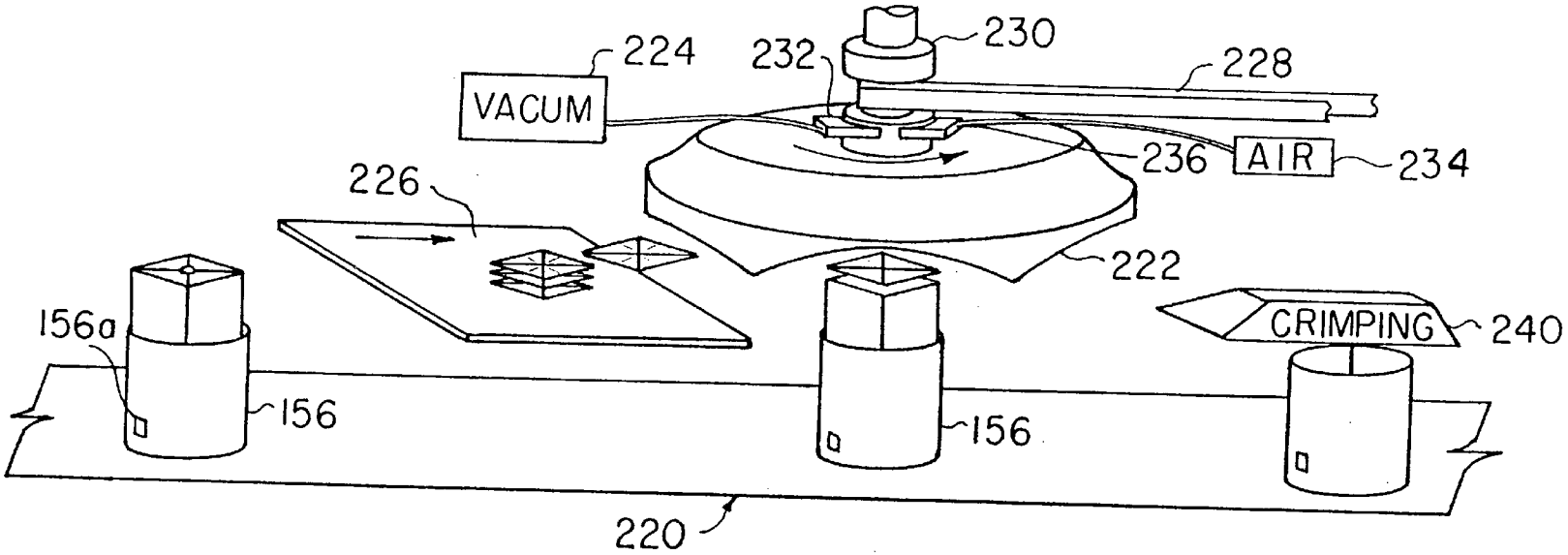
FIG. 21*a* is a schematic, isometric view of a production line showing the container tops placed on the integrated package, followed by crimping for securing the tops thereto.
Figure 21C:
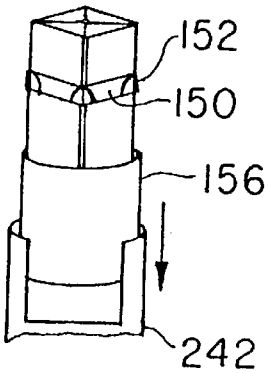
FIG. 21*c* is a perspective view of the cylinder as it is withdrawn downward from the package after the containers have been filled and the tops placed thereon.
Figure 21B:
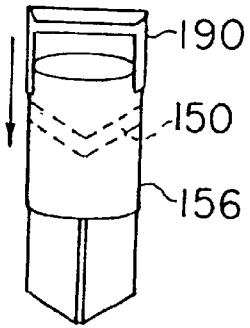
FIG. 21*b* is a perspective view of the cylinder as it is placed over the package.
Figure 22:
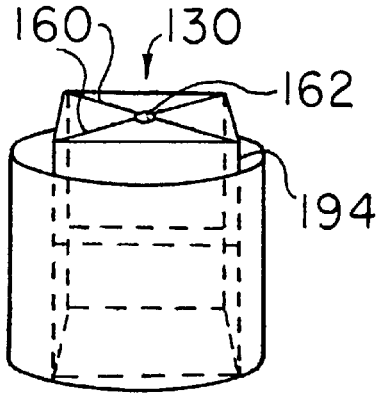
FIG. 22 is a perspective view showing an integrated container package and the cylinder received thereover.
Figure 23:
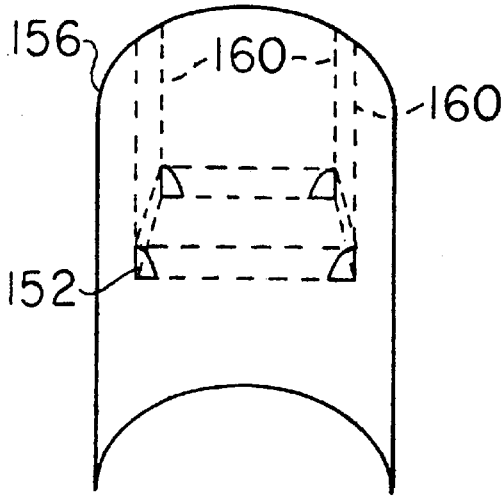
FIG. 23 is a cut-away view of the cylinder, which shows by hidden lines the position of the container band and support clips.
Figure 24:
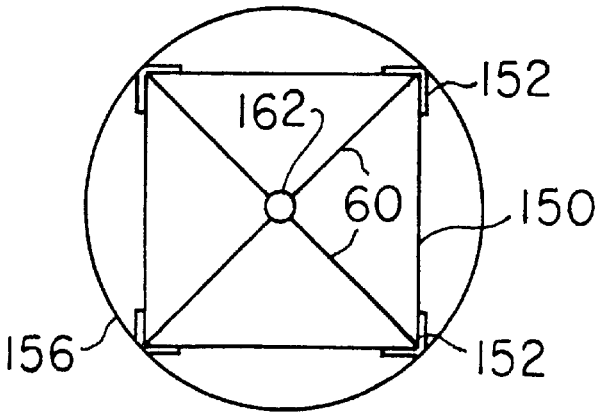
FIG. 24 is a top plan view of the cylinder and package configuration of FIG. 22.
Figure 25:
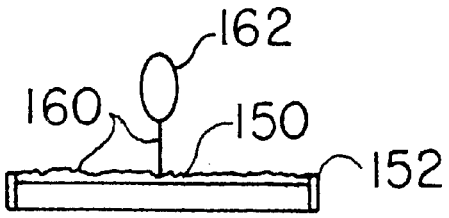
FIG. 25 is a plan view of the band used for securing together the individual containers.
Figure 26:
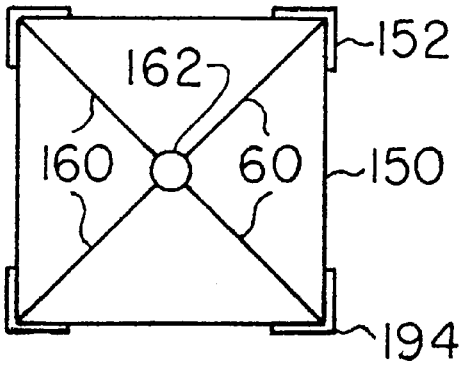
FIG. 26 is side elevation view of the band showing in greater detail the finger ring.
Figure 27:
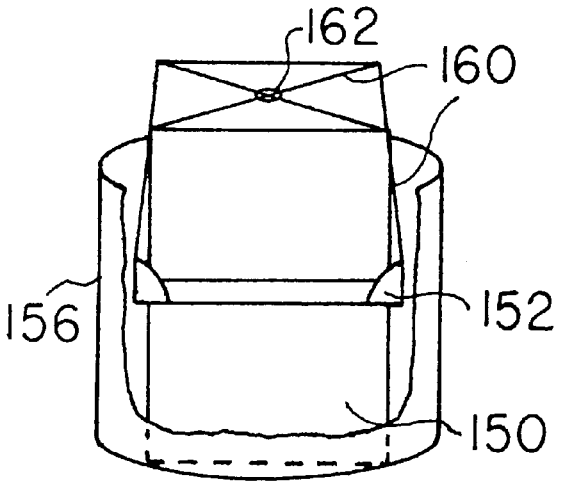
FIG. 27 is a cutaway view of a container held within a cylinder for processing.

In one preferred aspect of the invention, the cylinder 156 can be formed from steel, aluminum, or reinforced plastic. The cylinder 156 includes a side notch 156*a* (FIG. 21*a*) that is engaged by an orientation mechanism during container filling so as to properly orient the package during filling. The cylinder 156 is held to the package by the clips 152 and band 150.

Figure 20:
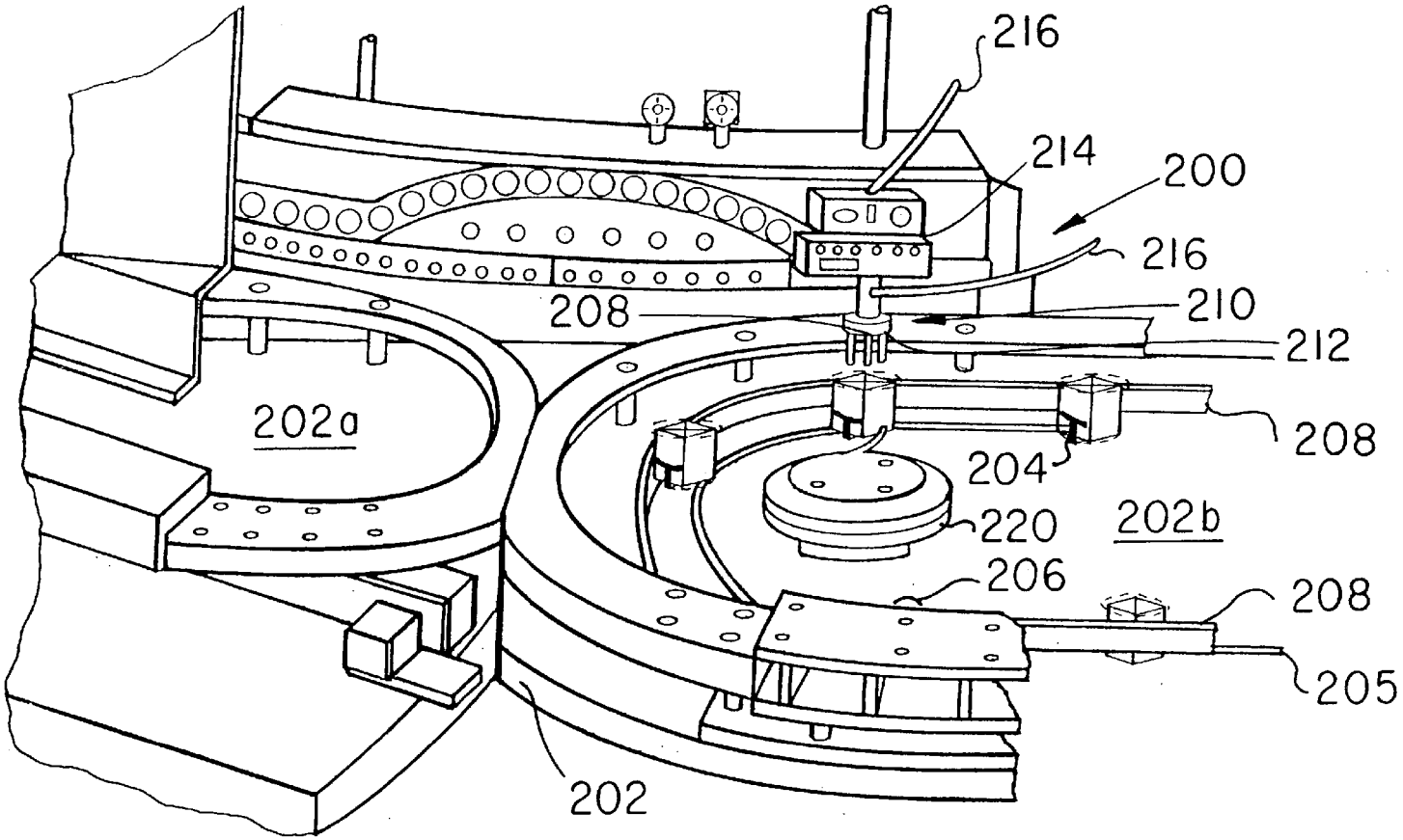
FIG. 20 is a perspective view of a container filling line showing the sequential filling of integrated packages in accordance with the present invention.

The combination cylinder 156 and package 130 is then transferred to a filling apparatus indicated generally at 200 (FIG. 20). The filling apparatus 200 is a conventional filling apparatus that has been modified for use with the packages 130 of the present invention. The illustrated filling apparatus 200 is only one type among many different types of filling apparatus that could be modified and used for the present invention.

The filling apparatus 200 includes a frame 202 having opposing sides 202*a*, 202*b* for filling two separate container package lines. As illustrated, only the right side line 202*b* is illustrated as being operable.

A transport assembly is positioned under the frame and includes vertical push rods 204 that extend upward through a slot 205 in the frame flooring 206 to engage the cylinder 156 and force the cylinder and package combination along a predetermined path of travel defined by the slot 205. Each push rod 204 includes a cylinder engaging bracket 204*a* that extends circumferentially around a portion of the cylinder. The bracket 204*a* allows the cylinder 156 to turn relative to the bracket 204*a*.

A guide rail 208 extends along the path of travel into the filling station 210. The filling station 210 includes a four orifice nozzle assembly 212 operatively connected to a control mechanism 214. Fluid is pumped from supply lines 216 to the nozzle assembly 212. Internal valving and pumping controls the amount and timing of fluid from the nozzle assembly 212. An optical scanner 218 scans the package as it enters the filling station 210. A control arm assembly 220 engages the notch 156*a* on the cylinder to orient the cylinder at the station 210 for proper filling of all four containers without spillage.

The cylinder 156 allows the rectangular configured package to be rapidly moved into the fill station 210 because the cylinder 156 can engage the guide rail 208 and can roll relative to the guide rail 208 and cylinder engaging bracket 204*a* to ensure adequate cylinder and package advancement without jamming or blockage. It is also possible to advance the cylinders by other methods such as horizontally rolling the cylinders, and then vertically upending the cylinders such as by a belt transmission prior to filling. The selected method depends on that chosen by one skilled in the art.

The filled containers then proceed to a top placement and crimp processing line 220 (FIG. 21*a*) where tops 136 are received on a rotary vacuum and pressure feed mechanism 222, acting similar to a turnstile. Vacuum drawn from a vacuum source 224 through orifices (not shown) in the turnstile draws one set of four tops and moves the tops 136 into a position over an advancing package. The tops 136 can be held together by a thin membrane of plastic or other similar means and stacked one on top of the other on a platform 226, which can be moved under the turnstile 222.

A belt drive transmission 228 engages a drive spindle 230 which turns the turnstile as the belt transmission 228 moves. A vacuum port and collar assembly 232 communicates with the vacuum source 224 and a port (not shown) positioned in the spindle 230. The port aligns with the vacuum port and collar assembly 232 as the turnstile 222 rotates. The first set of tops 236 positioned on the stack is drawn by vacuum onto the turnstile 222. Air pressure is generated from an air pressure source 234 to a pressure port and collar assembly 236 which aligns with the port as the turnstile rotates. As the turnstile 222 rotates further, the pressure is generated through the internal valve and port mechanism to force the vacuum drawn tops downward onto the package which has moved into position. Typically, rotation of the turnstile 222 is timed with the speed of the advancing cylinders 156 to ensure correct alignment of vacuum drawn tops over the packages 130.

The package then moves into a crimping station 240 where the placed tops are crimped onto the filled containers. After crimping, the cylinder 156 is forced by a cylinder grip assembly 242 downward through the floor of the processing line while the band 150 remains on the package 130 to hold the containers together. Once the cylinder 156 is removed, the tie bands 160 can be joined by the finger ring 162. Each package then can be lifted by raising the finger ring 162 which causes the band 150 to tighten circumferentially around the formed package to prevent the containers from disassembling with each other during lifting and transport.

The described method and apparatus are only one method and apparatus that can be used for container filling and top placement on the containers. Those skilled in the art will understand that different methods and apparatus could be used depending on the size of required containers and engineering requirements.

Although the present invention has been described above with reference to an isosceles configured container having a flat top and bottom which can be stacked one on top of the other, other container embodiments also can be used. A different filling sequence and apparatus may be desired depending on the type of desired container. Additionally, top placement followed by crimping would not be necessary when the containers have necks and screw-on caps.

Figure 29:
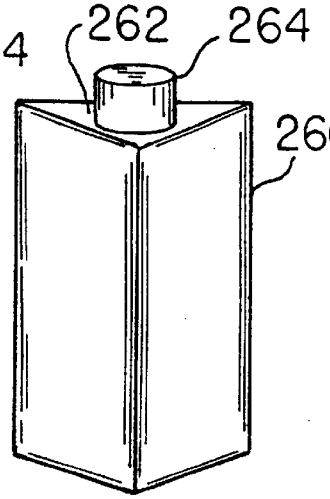
FIG. 29 is a front perspective view of another embodiment of the isosceles configured container having a short neck and screw cap.

FIG. 29 illustrates a front perspective view of another embodiment of the isosceles configured container 260 having a short neck 262 and screw cap 264. FIG. 12 illustrates still another isosceles configured container 265 such as could be formed from glass or blow-molded plastic having an upper apex configuration with the elongated neck 266 and screw cap 268.

Figure 30:
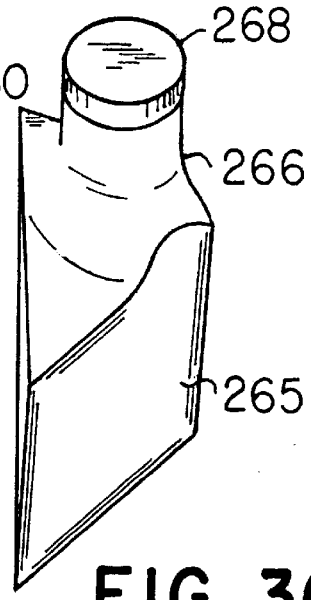
FIG. 30 is a left-side perspective view of another embodiment of the isosceles configured container incorporating an upper apex configuration with an elongated neck and screw cap.
Figure 31:
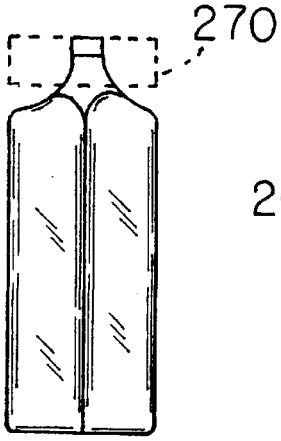
FIG. 31 is a front elevation view of the type of container shown in FIG. 29.
Figure 32:
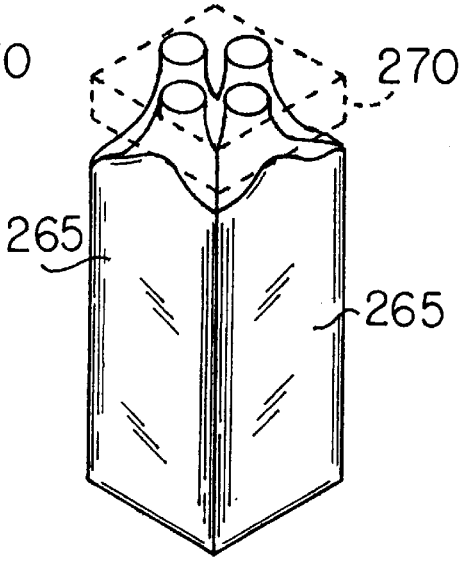
FIG. 32 is a perspective view of an integrated package formed from four containers of the embodiment shown in FIG. 30.
Figure 33:
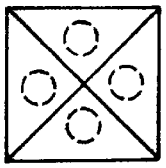
FIG. 33 is a plan view of the integrated package shown in FIG. 32.

FIGS. 31, 32 and 33 illustrate four of the containers as shown in the embodiment of FIG. 30 grouped together to form a package. A rectangular configured locking block 270 may be received over the necks 266 of the containers to hold the four containers together.

Figure 34:
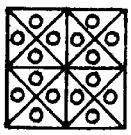
FIG. 34 is a plan view of four integrated packages formed from sixteen containers that are grouped together.

FIG. 34 illustrates four individual packages grouped together to form a substantially rectangular configuration. As noted before, the embodiment of FIG. 28 having the flat top and bottoms also may be formed as 2, 4, 16, 136 or 256 containers in a substantially rectangular configuration and held by the band. It is anticipated that four containers is optimum for filling in a rapidly-moving filling line.

Figure 41:
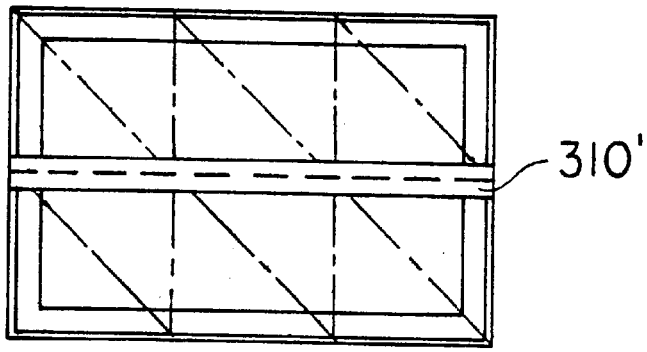
FIG. 41 is a plan view of a carrier for supporting a greater number of containers grouped together to form an integrated package configured as a rectangle.
Figure 42:
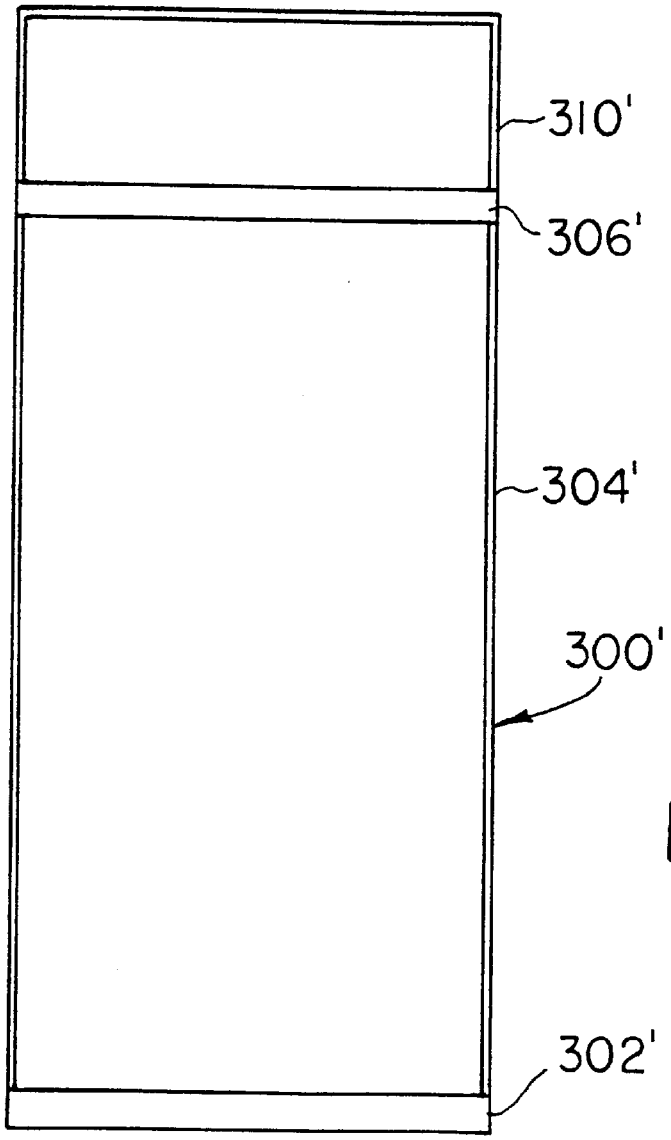
FIG. 42 is a side elevation view of the carrier of FIG. 41.
Figure 43:
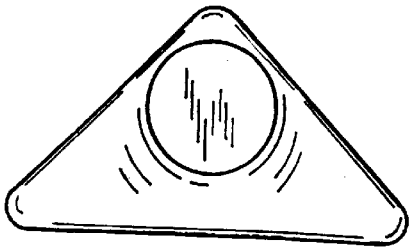
FIG. 43 is a top plan view of another isosceles configured container of the type shown in FIG. 30.
Figure 44:
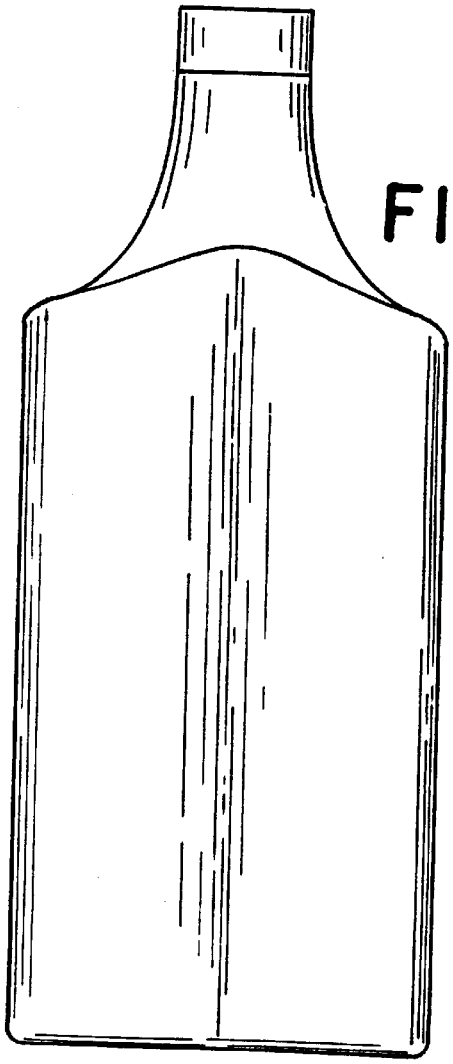
FIG. 44 is a rear elevation view of the container of FIG. 43.
Figure 45:
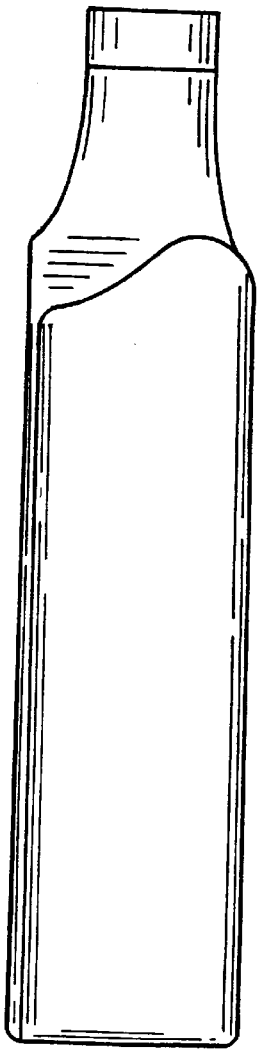
FIG. 45 is a side elevation view of the container of FIG. 43.
Figure 46:
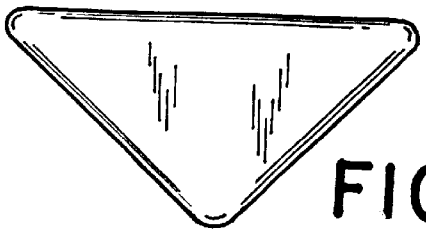
FIG. 46 is a bottom plan view of the container of FIG. 43.

FIGS. 36, 37 and 39–42 illustrate a carrier 300 for individual containers that are grouped together in a package. This carrier 300 is designed for consumers who can grasp the package in a retail point-of-purchase display and carry the package home. The carrier 300 includes a rectangular bottom support member 302 having four vertically extending corner supports 304 and a rectangular configured top support member 306, forming a three-dimensional rectangular carrier. A handle 310 connects the top support member. The handle can be pivotally attached. The formed 130 package is then inserted into the carrier. FIGS. 36, 37, 39 and 40 illustrate a carrier for two containers grouped together and forming a substantially square configuration. FIGS. 41 and 42 illustrate a carrier for twelve containers, and formed substantially rectangular. The embodiment illustrated in FIGS. 41 and 42 are indicated with reference numerals having prime rotation.

FIGS. 43 through 62 illustrates other types of embodiments of containers that could be juxtaposed together into a package for point-of-purchase display in a retail environment.

Figure 47:
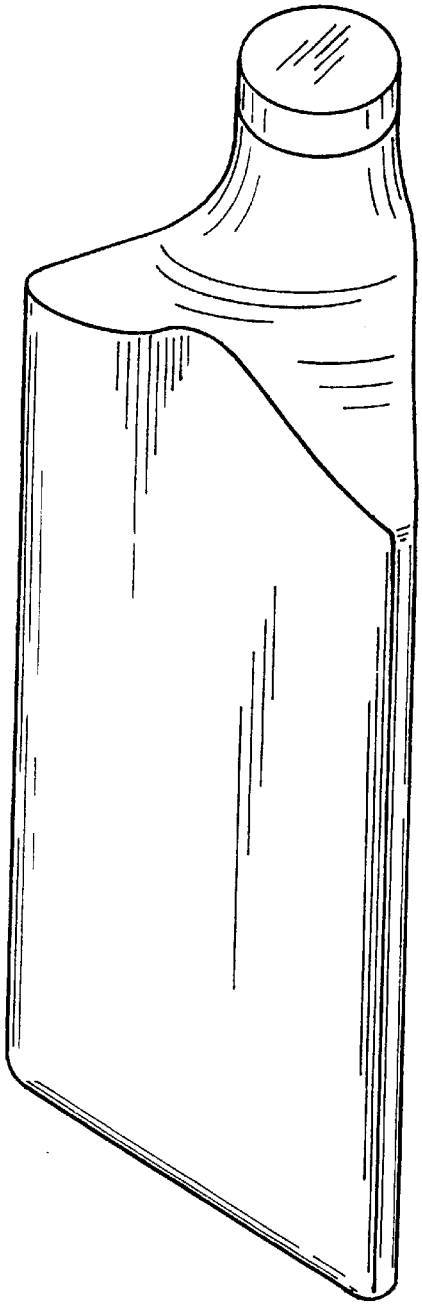
FIGS. 47 and 48 are perspective view of the container shown in FIGS. 43–46.
Figure 48:
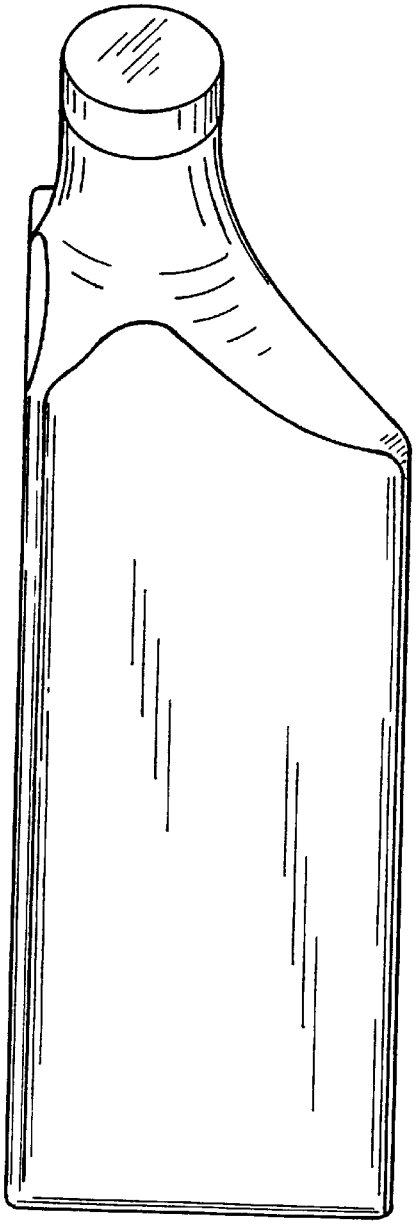

FIGS. 43 through 46 illustrate a container similar to that shown in FIG. 30 and FIGS. 47 and 48 show an environmental perspective view of the container.

Figure 49:
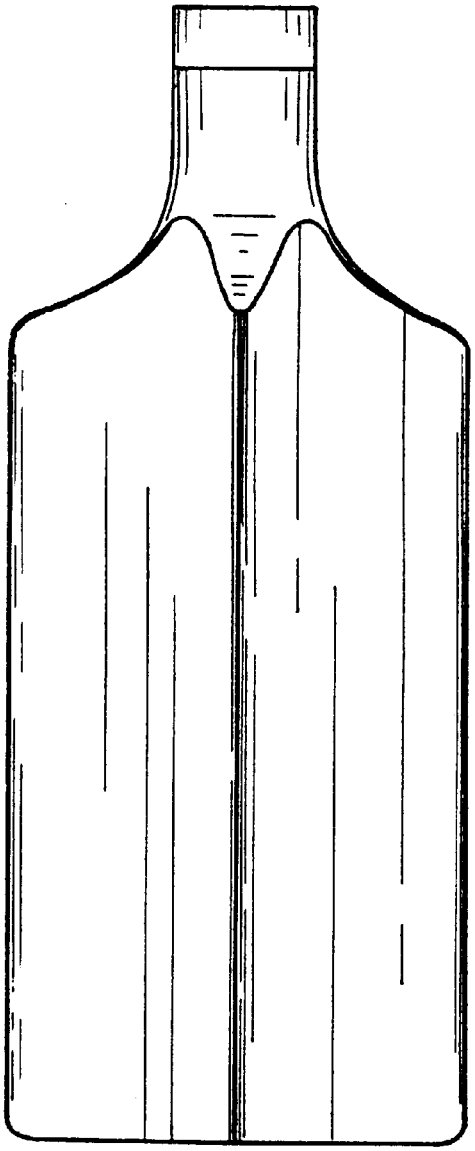
FIGS. 49 and 50 show two juxtaposed containers of the type shown in FIGS. 47 and 48.
Figure 50:
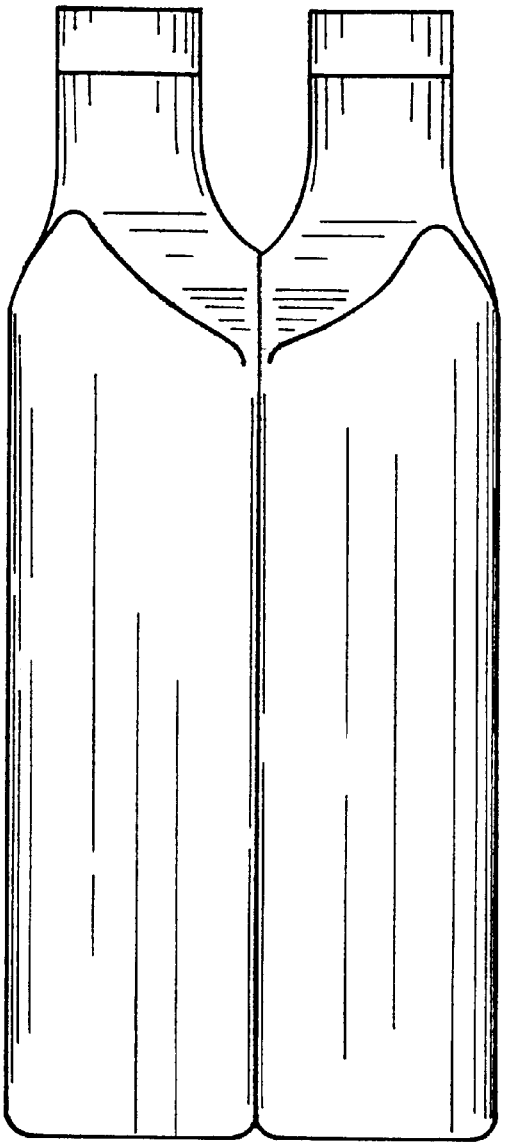

FIGS. 49 and 50 show two of the containers juxtaposed together.

Figure 51:
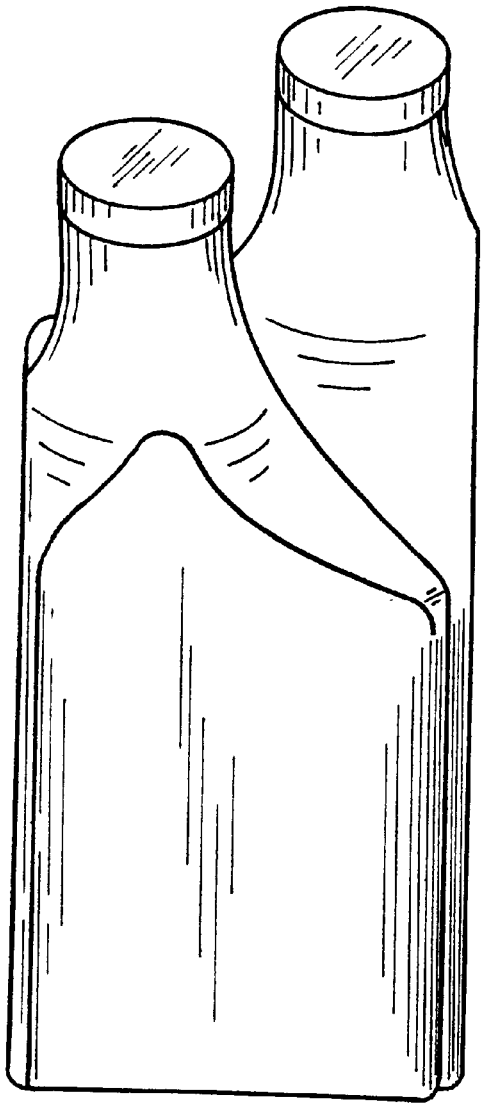
FIG. 51 is a perspective view of two juxtaposed containers with a shorter body.
Figure 52:
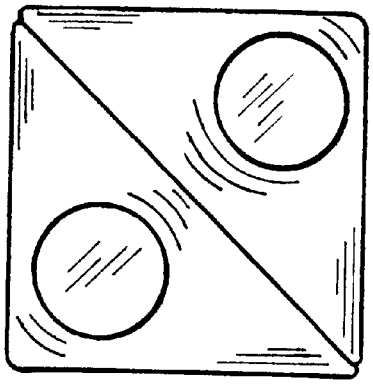
FIG. 52 is a top plan view of the juxtaposed containers of FIG. 51.
Figure 53:
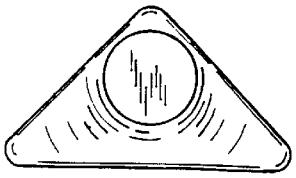
FIGS. 53–56 show views similar to FIGS. 43–46 of a similar type of container but having a shorter body.
Figure 54:
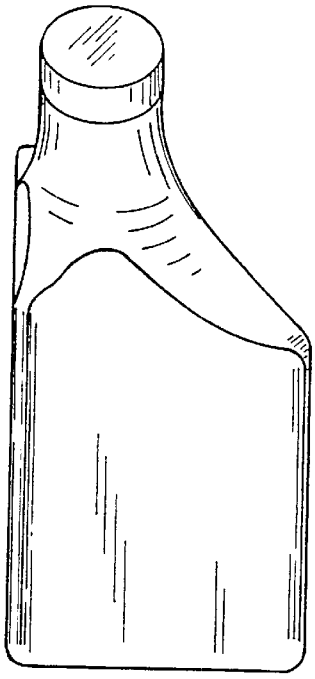
Figure 55:
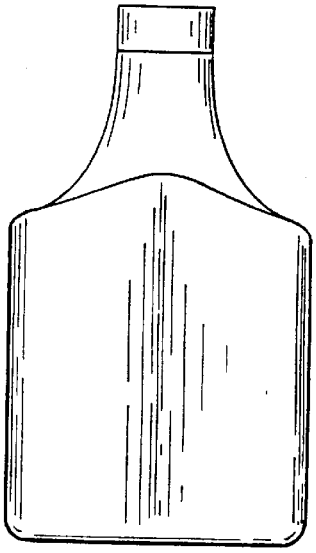
Figure 56:
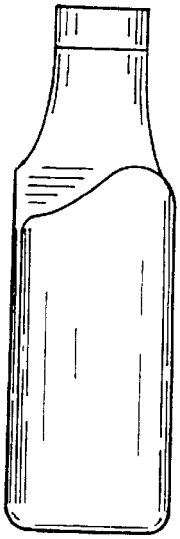

FIGS. 51 and 52 illustrates the same type of container but with a shorter body as well as FIGS. 53 through 56.

Figure 57:
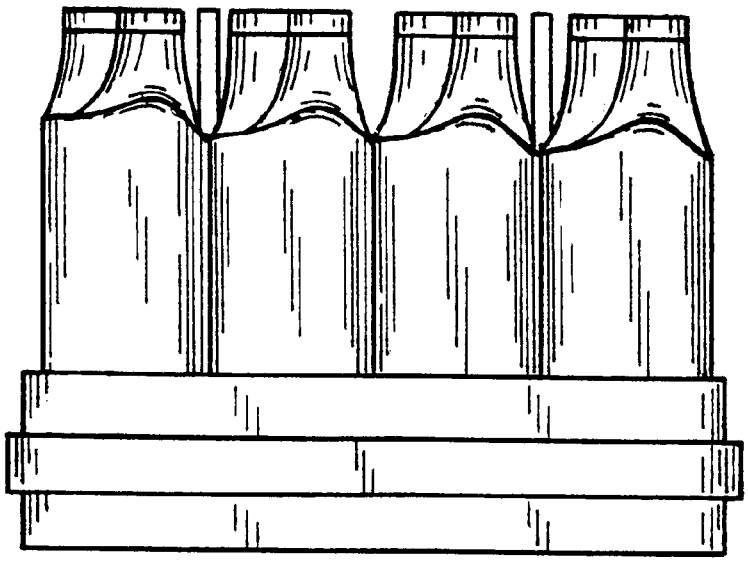
FIG. 57 is a side elevation view of the containers of FIGS. 43–50 juxtaposed together and held within a carrier.
Figure 58:
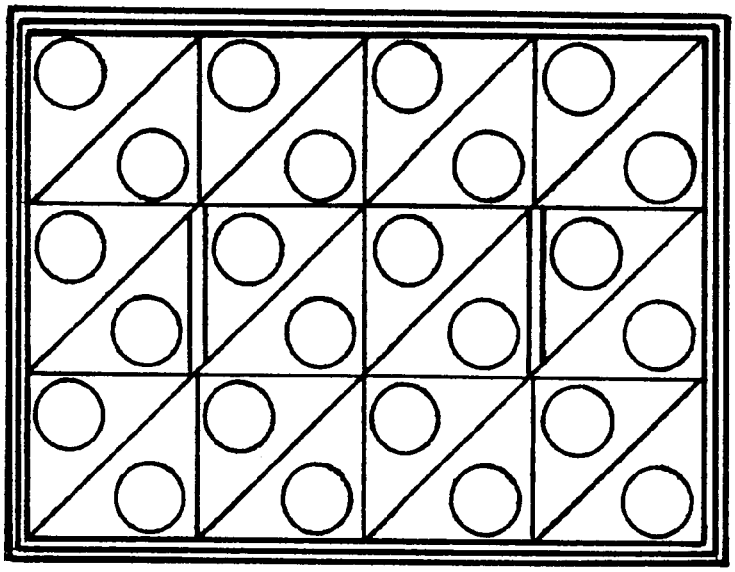
FIG. 58 is a plan view of the containers of FIG. 57 held within the carrier box bottom.
Figure 59:
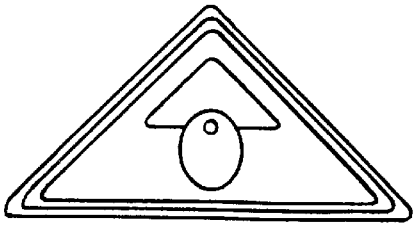
FIG. 59 is a top plan view of another type of isosceles configured container using a pull tab for an opening.
Figure 60:
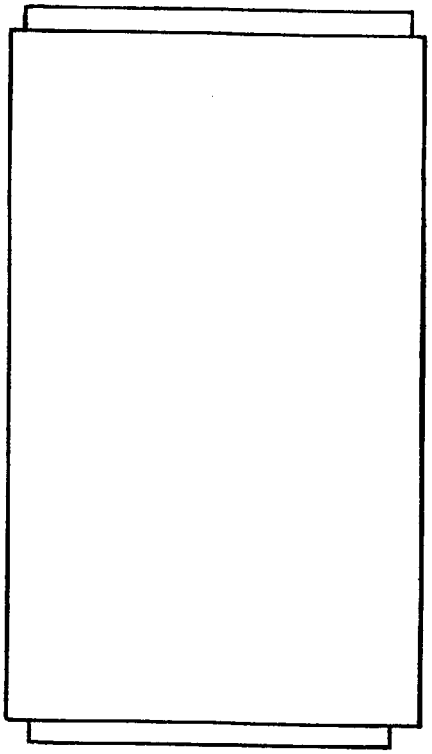
FIG. 60 is a front elevation view of the container of FIG. 59.
Figure 61:
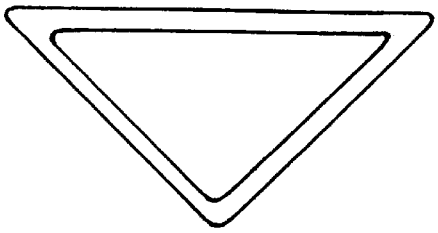
FIG. 61 is a bottom plan view of the container of FIG. 61.

FIGS. 57 and 58 illustrate a carrier used for holding a plurality of different containers.

FIGS. 59 through 62 show another type of design using the pull tab as illustrated in the containers shown in FIG. 17.

It should be understood that the foregoing description of the invention is intended merely to be illustrative thereof, and that other embodiments, modifications and equivalents may be apparent to those skilled in the art without departing from its spirit.

That which is claimed is:

1. An integrated package of containers comprising:

at least two individual, isosceles configured containers, wherein each container is substantially triangular in horizontal section and forming first, second and third walls and having a top and closed bottom, and wherein said top of the container is formed as a substantially t-top closure formed from first and second pinched walls converging at the third wall, and wherein the containers are selectively dimensioned and juxtaposed together so that the containers form a rectangular configured package, and means for holding the containers together to maintain the juxtaposed containers in the substantially rectangular configuration.

2. An integrated package of containers according to claim 1 wherein said third wall of each container converges inward toward a medial portion of the respective container at the t-top closure.

3. An integrated package of containers according to claim 1 wherein each container is formed from plastic.

4. An integrated package of containers according to claim 1 wherein each container is formed from metal.

5. An integrated package of containers according to claim 1 wherein each container is formed from a transparent material such that the contents of the container are readily discernable to a viewer.

6. An integrated package of containers according to claim 1 wherein said container is formed from paperboard.

7. A container comprising:

an isosceles configured body that is substantially triangular in horizontal section and forming first, second and third walls and having a top and closed bottom, and wherein said top of the container is formed as a substantially t-top closure formed from first and second pinched walls converging at the third wall.

8. A container according to claim 7 wherein said third wall of the container converges inward toward a medial portion of the container defined at the t-top closure.

9. A container according to claim 7 wherein said container is formed from plastic.

10. A container according to claim 7 wherein said container is formed from metal.

11. A container according to claim 7 wherein said container is formed from paperboard.

12. A container according to claim 7 wherein said contained is formed from a transparent material such that the contents of the container are readily visible to a viewer.

13. A method for filling a compartmentalized package with fluid or solid dispersant for point-of-purchase display comprising the steps of:

filling at least two containers with fluid or solid dispersant, wherein each container is formed from an isosceles configured body that is substantially triangular in horizontal section and forming first, second and third walls and having an open top and closed bottom, closing each open top by pressing first and second walls so that the two walls converge against the third wall and form a closed, substantially t-top closure, and juxtaposing at least two containers against each other in such manner that the two juxtaposed containers form a substantially rectangular configured package.

14. The method according to claim 13 including adding an adhesive tape onto each t-top closure to maintain the t-top closure in a closed state.

15. The method according to claim 13 including the step of securing the containers together for maintaining the containers together for a point-of-purchase display.

16. The method according to claim 13 including the step of holding the containers together by an adhesive tape.

17. A method for filling a container with fluid or solid dispersant and then closing the container for point-of-purchase display comprising the steps of:

filling a container with fluid or solid dispersant, wherein the container is formed from an isosceles configured body that is substantially triangular in horizontal section and forming first, second and third walls and having an open top and closed bottom, and closing the open top by pressing first and second walls so that the two walls converge against the third wall and form a closed, substantially t-top closure.

18. The method according to claim 17 including the step of juxtaposing at least two containers against each other in such manner that the two juxtaposed containers form a substantially rectangular configured package.

19. The method according to claim 17 including the step of holding the containers together by a adhesive tape.

20. The method according to claim 17 including adding an adhesive tape onto the t-top closure to maintain the t-top closure in a closed state.

21. The method according to claim 17 including bonding the t-top in the closed position by an adhesive.

22. A method for filling a compartmentalized package with fluid or solid dispersant for point-of-purchase display comprising the steps of:

filling at least two containers with fluid or solid dispersant, wherein each container is formed from an isosceles configured body that is substantially triangular in horizontal section and forming first, second and third walls and having an open top and closed bottom, closing each open top by pressing first and second walls so that the two walls converge against the third wall and form a closed, substantially t-top closure, and wherein before filling, the two containers have been juxtaposed against each other in such manner that the two juxtaposed containers form a substantially rectangular configured package.

23. The method according to claim 22 including adding an adhesive tape onto the t-top closure to maintain the t-top closure in a closed state.

24. The method according to claim 22 including the step of adding a bond to the containers for maintaining the containers together.

25. An integrated package of containers which may be manually carried comprising:

a plurality of individual, isosceles configured containers that are each substantially triangular in horizontal section, each container having a substantially flat top and being substantially equal in height to each other, and selectively dimensioned such that when juxtaposed together the containers have complementary fitting sidewalls and form a rectangular configured package that has a substantially flat top surface, a flexible band extending circumferentially around the package, said band including support clips engaging each corner of the package, a tie band operatively connected to each support clip and extending upward substantially along the package corners and along the flat top surface of the package toward a medial portion near the intersection of the containers, and means joining each tie band adjacent the intersection along the flat top surface of the containers such that the upward pulling on the joining means such as during carrying by means of the joining means causes the flexible band to tighten on the periphery of the package to aid in holding the individual containers together as a unit.

26. A blank used for forming a container that can be juxtaposed with at least one other similar container to form a rectangular configured package adapted for point-of-purchase displays, comprising:

a substantially rectangular blank formed from a thin, flexible material, and having parallel top and bottom sides and parallel opposing sides, three parallel fold lines extending from the top to the bottom side and parallel to the opposing sides, and forming first and second rectangular wall units corresponding to first and second walls of the container, and a third rectangular wall unit that is greater in width than the first and second wall units corresponding to a third wall of the container, a triangular configured bottom wall unit formed at the bottom side of the third wall unit, and having tabs extending therefrom and corresponding to the container bottom, and a triangular cutout formed along the top side of first and second wall units, and having an apex at the fold line dividing first and second wall units, wherein the wall units are folded along first, second and third fold lines and the triangular configured bottom wall unit folded along the bottom side so as to form an isosceles configured container body, and wherein adjacent the top of the container, first and second walls may be pinched inward to converge against the third wall to form a t-top closure.

27. The blank according to claim 26 including a fold line adjacent the top side on respective first and second wall units to aid in pinching first and second walls together against the third wall.

28. The blank according to claim 26 including a side tab adjacent the first wall unit and extending from the top to bottom side.

29. The blank according to claim 26 including a triangular configured reinforcing wall extending from the bottom side of the first wall unit to act as a reinforcing wall to the corresponding container bottom.

30. The blank according to claim 26 wherein the blank is formed from a transparent plastic so that when formed as a container, any container contents are readily visible.

* * * * *